US009254650B2

(12) United States Patent
Horikawa et al.

(10) Patent No.: US 9,254,650 B2
(45) Date of Patent: Feb. 9, 2016

(54) THERMAL PRINTHEAD AND METHOD OF MANUFACTURING THE SAME

(71) Applicant: ROHM CO., LTD., Kyoto-shi, Kyoto (JP)

(72) Inventors: Tomohiko Horikawa, Kyoto (JP); Hideaki Hoki, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 13/870,540

(22) Filed: Apr. 25, 2013

(65) Prior Publication Data

US 2013/0307907 A1 Nov. 21, 2013

(30) Foreign Application Priority Data

Apr. 27, 2012 (JP) ..... 2012-102925

(51) Int. Cl.

| | |
|---|---|
| ***B41J 2/05*** | (2006.01) |
| ***B41J 2/14*** | (2006.01) |
| ***B41J 2/16*** | (2006.01) |
| ***B41J 2/335*** | (2006.01) |
| ***B41J 2/345*** | (2006.01) |

(52) U.S. Cl.

CPC ..... *B41J 2/14129* (2013.01); *B41J 2/1621* (2013.01); *B41J 2/3351* (2013.01); *B41J 2/3355* (2013.01); *B41J 2/3357* (2013.01); *B41J 2/3359* (2013.01); *B41J 2/33545* (2013.01); *B41J 2/345* (2013.01); *B41J 2/3354* (2013.01); *Y10T 29/49083* (2015.01)

(58) Field of Classification Search

None

See application file for complete search history.

(56) References Cited

U.S. PATENT DOCUMENTS

2009/0201356 A1 * 8/2009 Yamade et al. ..... 347/204

FOREIGN PATENT DOCUMENTS

| | | |
|---|---|---|
| JP | 2012-51319 | 3/2012 |
| JP | 2012051319 A * | 3/2012 |

* cited by examiner

*Primary Examiner* — Erica Lin

(74) *Attorney, Agent, or Firm* — Hamre, Schumann, Mueller & Larson, P.C.

(57) ABSTRACT

A thermal printhead includes a substrate, a resistor layer formed on the substrate, an electrode layer formed on the substrate and electrically connected to the resistor layer, and an insulating layer. The electrode layer includes a first electrically conductive portion and a second electrically conductive portion spaced apart from each other. The resistor layer includes a heater portion that bridges the first electrically conductive portion and the second electrically conductive portion as viewed in the thickness direction of the substrate. The insulating layer includes a portion positioned between the electrode layer and the heater portion. This arrangement reduces formation of a eutectic region between the heater portion and the electrode layer.

6 Claims, 27 Drawing Sheets

THERMAL PRINTHEAD AND METHOD OF MANUFACTURING THE SAME

BACKGROUND OF THE INVENTION

1. Field of the Invention

The present invention relates to a thermal printhead and a method of manufacturing a thermal printhead.

2. Description of Related Art

A conventionally known thermal printhead includes a substrate, a glaze layer, a heating resistor and an electrode. This type of thermal printhead is disclosed in e.g. JP-A-2012-51319. In the thermal printhead disclosed in this document, the glaze layer is on the substrate. The glaze layer serves to store the heat generated at the heating resistor. The heating resistor is on the glaze layer. The electrode includes two portions spaced apart from each other. The heating resistor has a heater portion that bridges these two portions.

During the use of the thermal printhead, the heater portion heats up to an extremely high temperature. When the heater portion heats up, a eutectic region may be formed at the portion where the heater portion and the electrode are in contact with each other. When a eutectic region is formed at the contact portion of the heater portion and the electrode, the characteristics of the heater portion or the electrode will change, which may cause the resistance of the thermal printhead to change to a value different from a desired value.

SUMMARY OF THE INVENTION

The present invention has been proposed in view of the foregoing situation. It is therefore an object of the present invention to provide a thermal printhead that reduces the formation of a eutectic region between the heater portion of the resistor layer and the electrode layer.

According to a first aspect of the present invention, there is provided a thermal printhead comprising a substrate, a resistor layer formed on the substrate, an electrode layer formed on the substrate and electrically connected to the resistor layer, and an insulating layer. The electrode layer includes a first electrically conductive portion and a second electrically conductive portion spaced apart from each other. The resistor layer includes a heater portion that bridges the first electrically conductive portion and the second electrically conductive portion as viewed in a thickness direction of the substrate. The insulating layer includes a portion positioned between the electrode layer and the heater portion.

Preferably, the insulating layer includes a first interposing portion and a second interposing portion. The first interposing portion is positioned between the first electrically conductive portion and the heater portion. The second interposing portion is positioned between the second electrically conductive portion and the heater portion.

Preferably, the insulating layer includes an intermediate portion sandwiched between the first interposing portion and the second interposing portion as viewed in the thickness direction of the substrate. The intermediate portion is connected to the first interposing portion and the second interposing portion.

Preferably, the first interposing portion includes a first opening. The heater portion includes a first contact portion that is in direct contact with a part of the first electrically conductive portion. The first contact portion is at a position overlapping the first opening as viewed in the thickness direction of the substrate.

Preferably, a part of the first electrically conductive portion is in the first opening.

Preferably, the second interposing portion includes a second opening. The heater portion includes a second contact portion that is in direct contact with a part of the second electrically conductive portion. The second contact portion is at a position overlapping the second opening as viewed in the thickness direction of the substrate.

Preferably, a part of the second electrically conductive portion is in the second opening.

Preferably, the resistor layer includes a first end surface facing the opposite side from the side where the second electrically conductive portion is positioned. The insulating layer includes a portion connected to the first interposing portion and covering the first end surface.

Preferably, the resistor layer includes a second end surface facing the opposite side from the side where the first electrically conductive portion is positioned. The insulating layer includes a portion connected to the second interposing portion and covering the second end surface.

Preferably, the thermal printhead further comprises a heat storage layer between the substrate and the heater portion.

Preferably, the resistor layer is positioned between the electrode layer and the heat storage layer.

Preferably, the heat storage layer includes a heat storage layer surface facing the side where the resistor layer is positioned. The heat storage layer surface is entirely flat.

Preferably, the substrate includes a substrate surface facing the side where the resistor layer is positioned. The heat storage layer covers the entirety of the substrate surface.

Preferably, the heat storage layer includes a portion that is in direct contact with the insulating layer.

Preferably, the substrate is made of a semiconductor material.

The thermal printhead further comprises a protective layer covering the resistor layer, the electrode layer and the insulating layer.

Preferably, the protective layer is in direct contact with the insulating layer.

Preferably, the thermal printhead further comprises a wiring board, a plurality of wires, and a resin layer covering the wiring board, the wires and the protective layer.

Preferably, the protective layer includes a through-hole. The electrode layer includes a bonding portion exposed through the through-hole. One of the wires is bonded to the bonding portion.

Preferably, the resin layer is in direct contact with the protective layer.

Preferably, the thermal printhead further comprises a driver IC for applying current to the electrode layer. The driver IC is built in the substrate.

Preferably, the thermal printhead further comprises a driver IC for applying current to the electrode layer. The driver IC is mounted on the wiring board.

Preferably, the insulating layer is made of $SiO_2$ or $SiAlO_2$.

Preferably, the resistor layer is made of at least any one of polysilicon, $TaSiO_2$ and TiON.

Preferably, the electrode layer is made of at least any one of Au, Ag, Cu, Cr, Al—Si and Ti.

Preferably, the electrode layer includes a barrier metal layer that is in direct contact with the heater portion.

According to a second aspect of the present invention, there is provided a method of manufacturing a thermal printhead according to the first aspect of the present invention. The method comprises the steps of forming the resistor layer on the substrate, forming the insulating layer on the substrate, and forming the electrode layer on the substrate. The step of forming the insulating layer is performed between the step of forming the electrode layer and the step of forming the resistor layer.

Preferably, the step of forming the resistor layer is performed by CVD or sputtering.

Preferably, the step of forming the insulating layer is performed by CVD or sputtering.

Preferably, the step of forming the electrode layer is performed by CVD or sputtering.

Preferably, the substrate is made of a semiconductor material.

Preferably, the method comprises the step of forming a heat storage layer on the substrate before all the steps of forming the resistor layer, forming the electrode layer and forming the insulating layer.

Preferably, the step of forming the heat storage layer is performed at least by CVD.

Preferably, the step of forming the heat storage layer includes a step of thermally oxidizing a surface of the semiconductor substrate.

Preferably, the method of manufacturing a thermal printhead further comprises the step of forming a protective layer to cover the resistor layer, the electrode layer and the insulating layer. The step of forming the protective layer is performed by CVD.

Other features and advantages of the present invention will become more apparent from detailed description given below with reference to the accompanying drawings.

DESCRIPTION OF THE PREFERRED EMBODIMENTS

Preferred embodiments of the present invention are described below with reference to the accompanying drawings.

First Embodiment

A first embodiment of the present invention is described below with reference to FIGS. 1-22.

Figure 1:
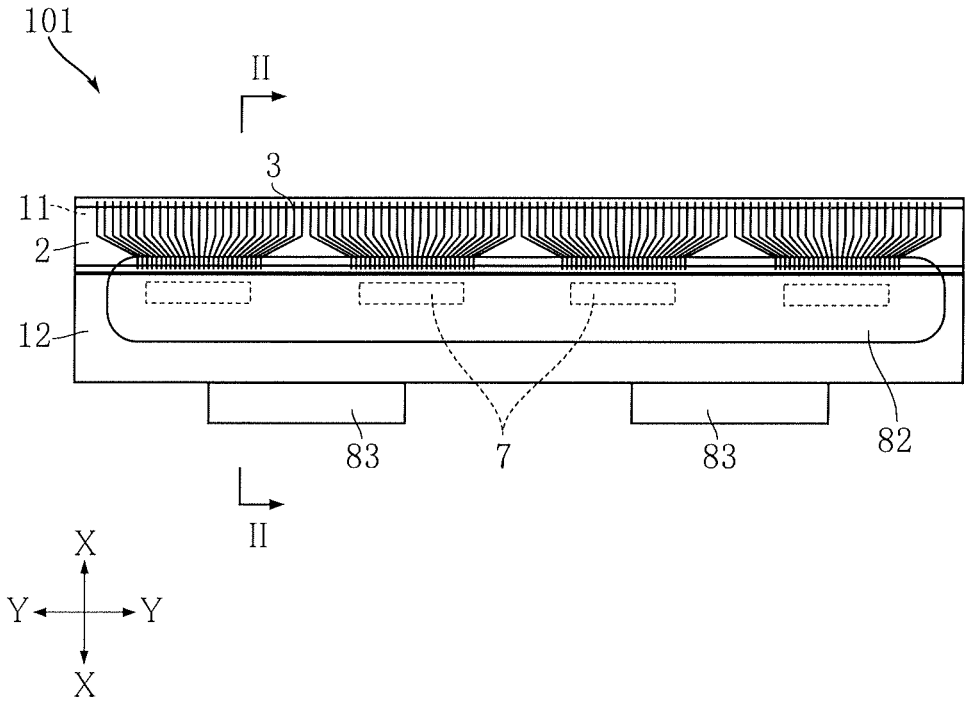
FIG. 1 is a plan view of a thermal printhead according to a first embodiment of the present invention.
Figure 2:
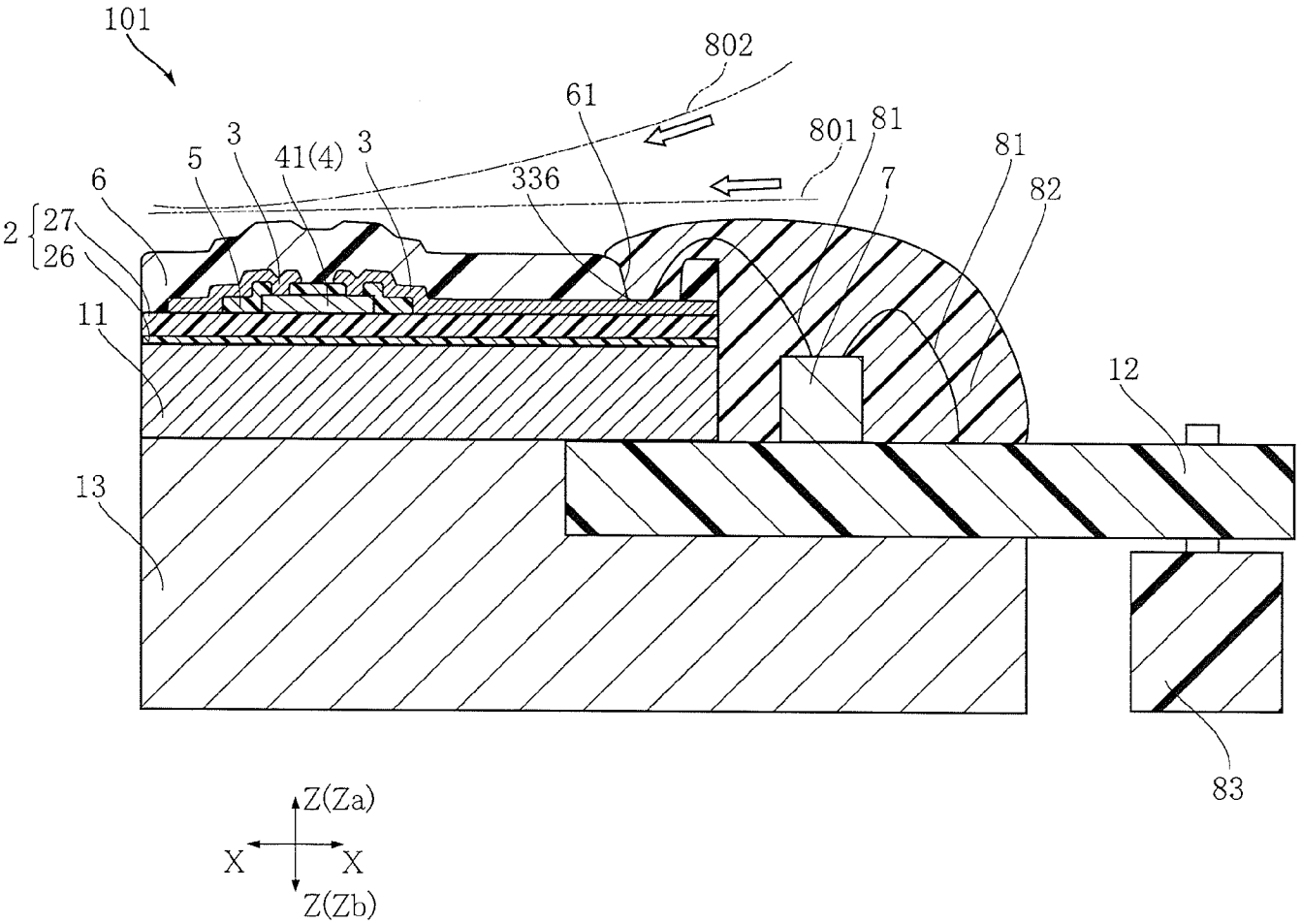
FIG. 2 is a sectional view taken along lines II-II in FIG. 1.

FIG. 1 is a plan view of a thermal printhead according to a first embodiment of the present invention. FIG. 2 is a sectional view taken along lines II-II in FIG. 1.

The thermal printhead 101 shown in these figures includes a substrate 11, a wiring board 12, a heat sink plate 13, a heat storage layer 2, an electrode layer 3, a resistor layer 4, an insulating layer 5, a protective layer 6 (not shown in FIG. 1), driver ICs 7, a plurality of wires 81, a sealing resin 82, and a connector 83. The thermal printhead 101 is to be incorporated in a printer for printing on a printing medium 801. Examples of the printing medium 801 include thermal paper for making barcode sheets or receipts.

The heat sink plate 13 shown in FIG. 2 functions to dissipate heat from the substrate 11. The heat sink plate 13 is made of a metal such as Al. The substrate 11 and the wiring board 12 are attached to the heat sink plate 13.

The substrate 11 is in the form of a plate. In this embodiment, the substrate 11 is made of a semiconductor material. Examples of the semiconductor material for the substrate 11 include Si, SiC, AlN, GaP, GaAs, InP and GaN. Although the substrate 11 is made of a semiconductor material in this embodiment, the substrate 11 may not be made of a semiconductor material. For instance, the substrate 11 may be made of an insulating material such as a ceramic material. The thickness of the substrate 11 is e.g. 0.625-0.720 mm. As shown in FIG. 1, the substrate 11 is in the form of a flat plate elongated in the direction Y. For instance, the width of the substrate 11 (the dimension of the substrate 11 in the direction X) is 3-20 mm. The dimension of the substrate 11 in the direction Y is e.g. 10-300 mm.

Figure 3:
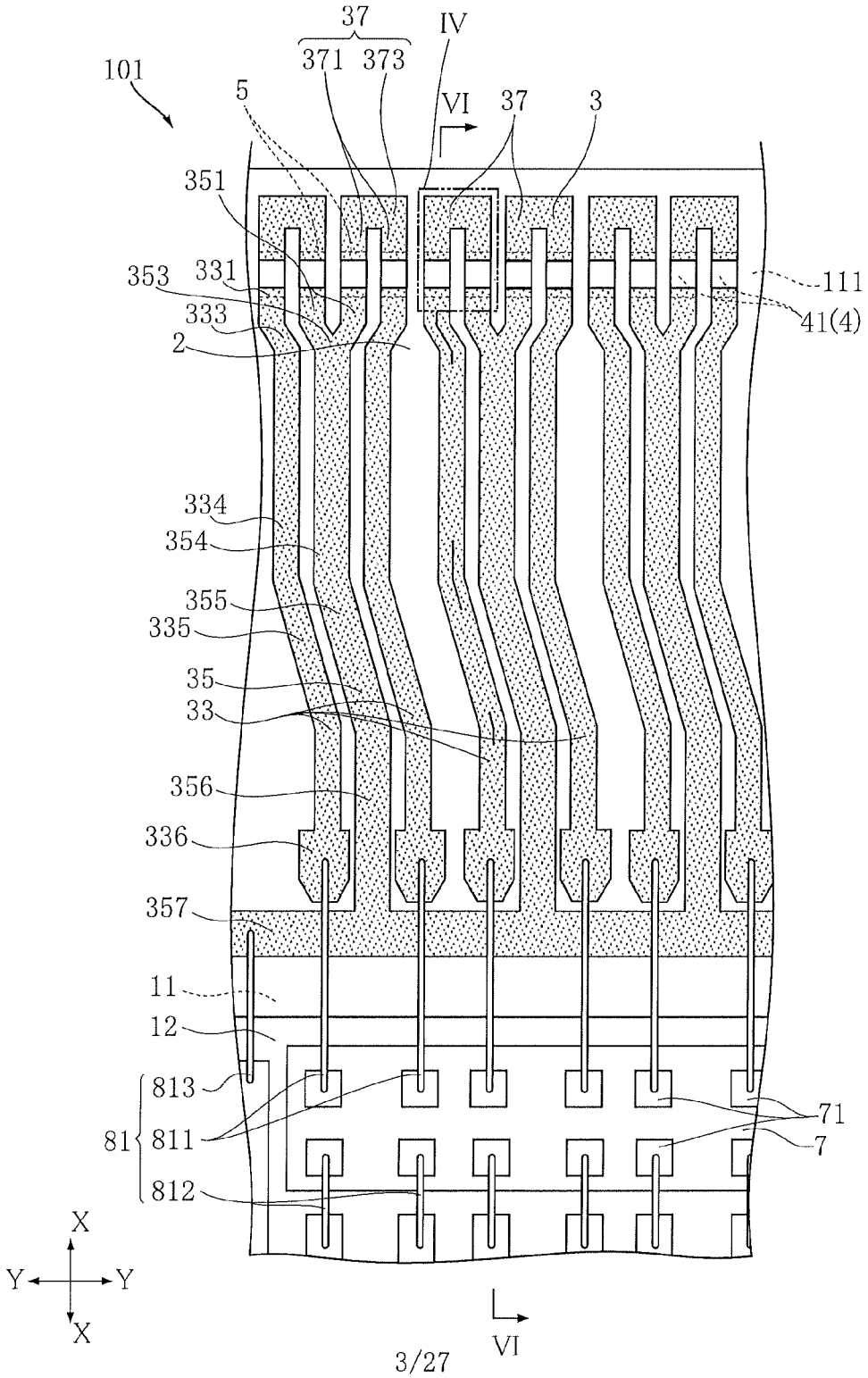
FIG. 3 is a schematic enlarged plan view of the thermal printhead shown in FIG. 1 (illustration of several parts omitted)
Figure 6:
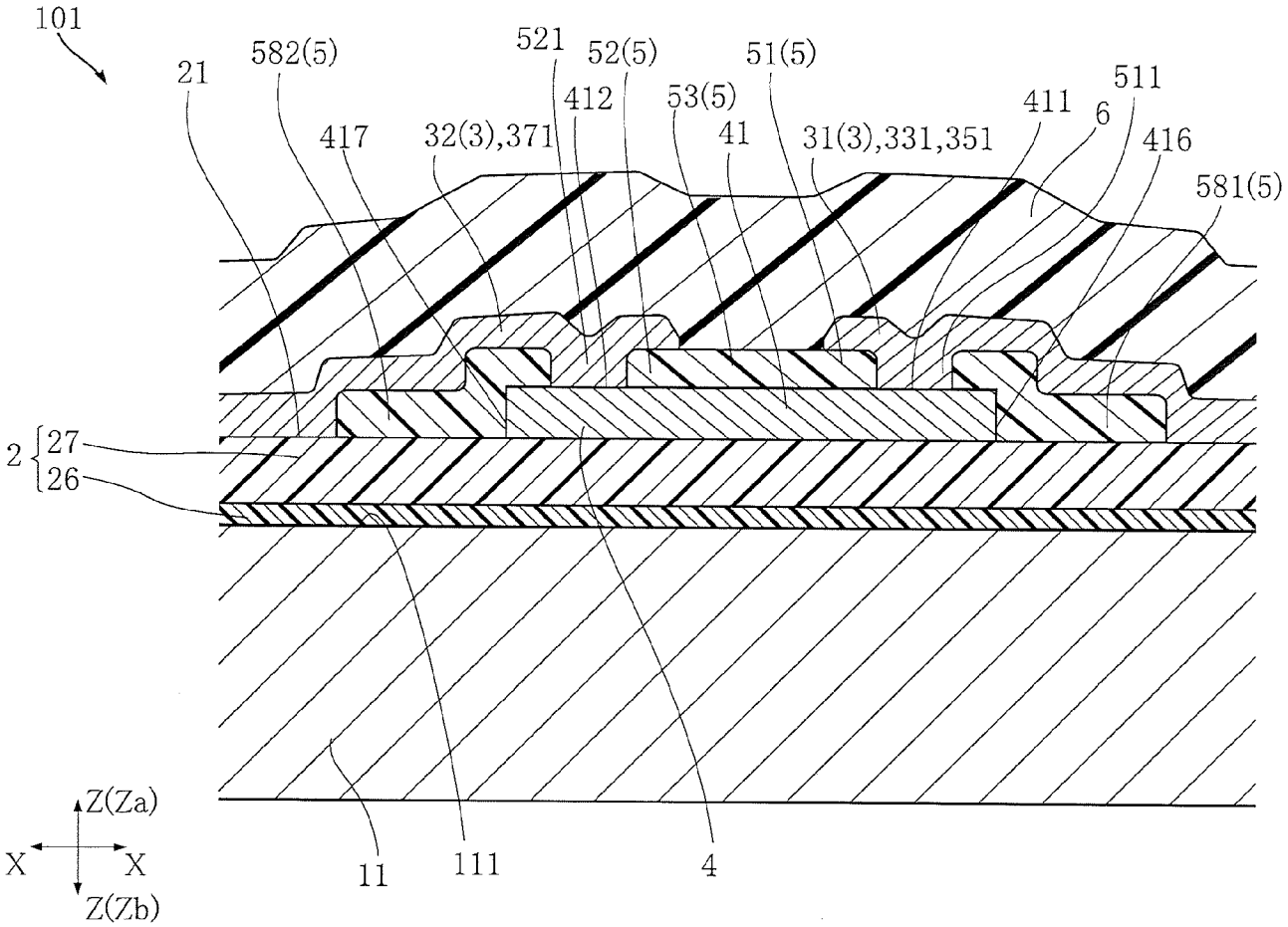
FIG. 6 is a schematic enlarged sectional view taken along lines VI-VI in FIG. 3.

FIG. 3 is a schematic enlarged plan view of the thermal printhead 101 shown in FIG. 1 (illustration of several parts omitted). FIG. 6 is a schematic enlarged sectional view taken along lines VI-VI in FIG. 3. In FIG. 3, illustration of the protective layer 6 and the sealing resin 82 is omitted.

As shown in FIG. 6, the substrate 11 has a substrate surface 111. The substrate surface 111 is a flat surface spreading in the direction X and in the direction Y. The substrate surface 111 is elongated in the direction Y. The substrate surface 111 faces one side in the thickness direction Z of the substrate 11. (Hereinafter, this side is referred to as "direction Za", which is the upper side in FIG. 6). That is, the substrate surface 111 is a surface that faces the side where the resistor layer 4 is positioned.

As shown in FIGS. 2 and 6, the heat storage layer 2 is on the substrate 11. The heat storage layer 2 covers the entirety of the substrate surface 111 of the substrate 11. The heat storage layer 2 stores heat generated at the heater portion 41 (which is described later). For instance, the thickness of the heat storage layer 2 is not less than 3 μm. As shown in FIG. 6, the heat storage layer 2 has a heat storage layer surface 21. The heat storage layer surface 21 faces the direction Za. That is, the heat storage layer surface 21 is a surface that faces the side where the resistor layer 4 is positioned. In this embodiment, the heat storage layer surface 21 is entirely flat. When the heat storage layer surface 21 is flat, forming the resistor layer 4 and the insulating layer 5 by a semiconductor process is easy.

As shown in FIGS. 2 and 6, the heat storage layer 2 in this embodiment includes a first layer 26 and a second layer 27. The first layer 26 is positioned between the second layer 27 and the substrate 11. The first layer 26 is made of an oxide of the semiconductor material forming the substrate 11. For instance, when the semiconductor material forming the substrate 11 is Si, the first layer 26 is made of $SiO_2$. The second layer 27 is made of an insulating material. Although the material for the second layer 27 is not limited to a specific one, the same material as that for the first layer 26 is employed in this embodiment. Unlike this embodiment, the heat storage may comprise a single layer, not two layers.

The electrode layer 3, which is shown in FIGS. 2, 3 and 6, is on the substrate 11. In FIG. 3, a sand pattern is applied to the electrode layer 3 for easier understanding. Specifically, the electrode layer 3 lies on the heat storage layer 2. Also, the electrode layer 3 lies on the resistor layer 4. In this embodiment, the resistor layer 4 is positioned between the electrode layer 3 and the heat storage layer 2. The electrode layer 3 is electrically connected to the resistor layer 4. The electrode layer 3 provides a path for supplying electric power to the resistor layer 4. Examples of the material for the electrode layer 3 include Au, Ag, Cu, Cr, Al—Si and Ti. Unlike this embodiment, the electrode layer 3 may be arranged between the heat storage layer 2 and the resistor layer 4.

Figure 4:
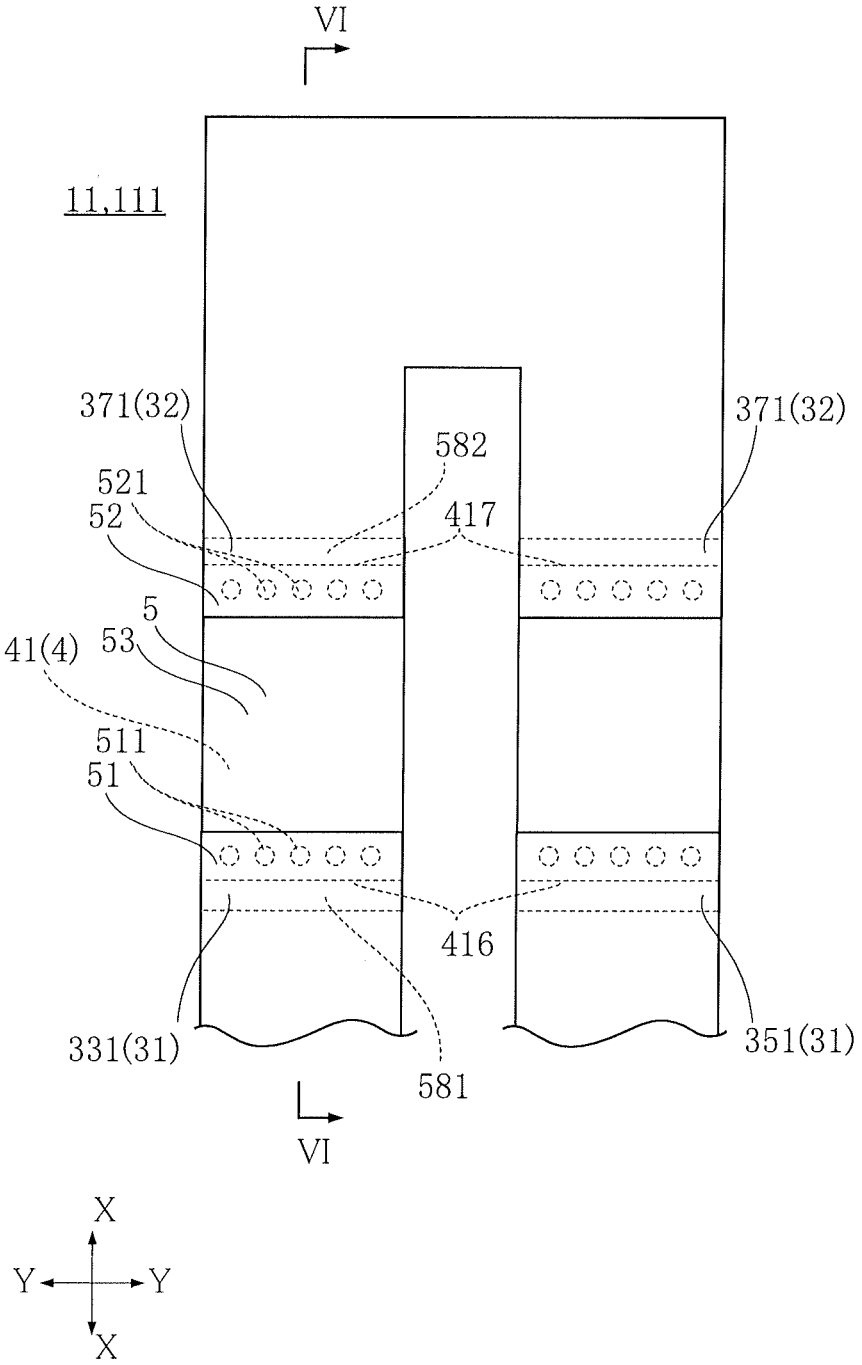
FIG. 4 is a schematic enlarged plan view of the region IV in FIG. 3.
Figure 5:
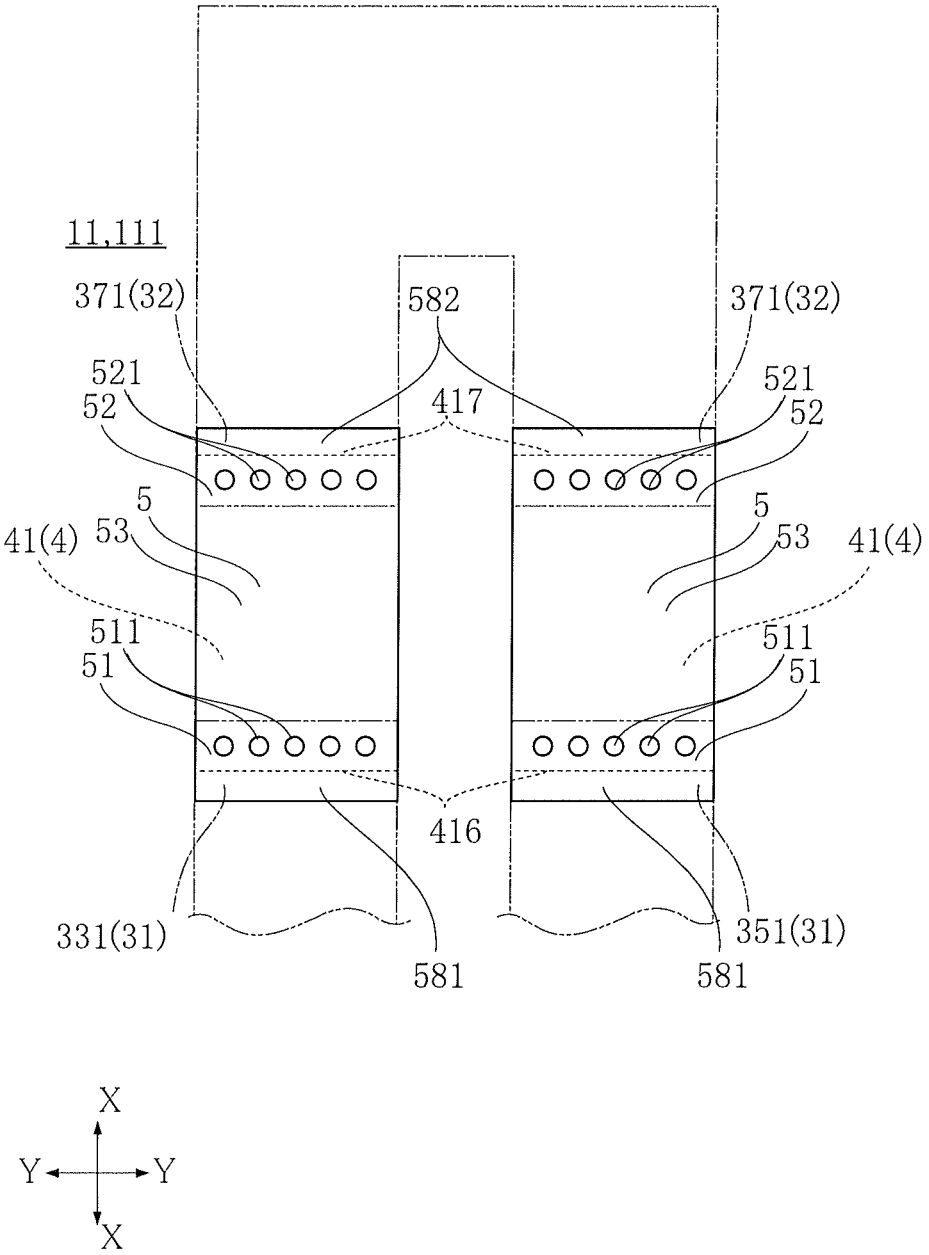
FIG. 5 is a plan view showing the state in which the electrode layer is omitted from FIG. 4.

FIG. 4 is a schematic enlarged plan view of the region IV in FIG. 3. FIG. 5 is a plan view showing the state in which the electrode layer is omitted from FIG. 4. Note that FIG. 6 corresponds to a sectional view taken along lines VI-VI in FIG. 4.

As shown in FIGS. 4 and 6, the electrode layer 3 includes a first electrically conductive portion 31 and a second electrically conductive portion 32. The first electrically conductive portion 31 and the second electrically conductive portion 32 are spaced apart from each other. For instance, the distance between the first electrically conductive portion 31 and the second electrically conductive portion 32 is 105 μm.

In this embodiment, as shown in FIG. 3, the electrode layer 3 includes a plurality of individual electrodes 33 (only six are shown in the figure), a common electrode 35 and a plurality of relay electrodes 37 (only six are shown in the figure). The specific structure is described below.

The individual electrodes 33 are not electrically connected to each other. Thus, during the use of the printer incorporating the thermal printhead 101, different potentials can be applied to the individual electrodes 33. Each of the individual electrodes 33 includes an individual electrode strip portion 331, a bent portion 333, a straight portion 334, a slant portion 335 and a bonding portion 336. As shown in FIGS. 4 and 6, the individual electrode strip portion 331 provides the first electrically conductive portion 31 of the electrode layer 3 and is in the form of a strip elongated in the direction X. Each individual electrode strip portion 331 is on the resistor layer 4. The bent portion 333 is connected to the individual electrode strip portion 331 and is inclined with respect to both of the direction Y and the direction X. The straight portion 334 extends straight in the direction X. The slant portion 335 extends in a direction inclined with respect to both of the direction Y and the direction X. A wire 81 is bonded to the bonding portion 336. In this embodiment, the individual electrode strip portion 331, the bent portion 333, the straight portion 334 and the slant portion 335 have a width of e.g. about 47.5 μm, whereas the bonding portion 336 has a width of e.g. about 80 μm.

When a printer incorporating the thermal printhead 101 is used, the common electrode 35 has a polarity reverse to that of the individual electrodes 33. The common electrode 35 includes a plurality of common electrode strip portions 351, a plurality of branch portions 353, a plurality of straight portions 354, a plurality of slant portions 355, a plurality of extensions 356 and a main portion 357. Each common electrode strip portion 351 is in the form of a strip elongated in the direction X. As shown in FIGS. 4 and 6, in the common electrode 35, each common electrode strip portion 351 provides the first electrically conductive portion 31 of the electrode layer 3. The common electrode strip portions 351 are spaced apart from each other in the direction Y and electrically connected to each other. The common electrode strip portions 351 are on the resistor layer 4. The common electrode strip portions 351 are spaced apart from the individual electrode strip portions 331 in the direction Y. In this embodiment, two adjacent common electrode strip portions 351 are sandwiched between two adjacent individual electrode strip portions 331. The common electrode strip portions 351 and the individual electrode strip portions 331 are arranged side by side in the direction Y. Each branch portion 353 is Y-shaped and connects two common electrode strip portions 351 to one of the straight portions 354. The straight portions 354 extend straight in the direction X. The slant portion 355 extends in a direction inclined with respect to both of the direction Y and the direction X. The extensions 356 are connected to the slant portions 355 and elongated in the direction X. The main portion 357 is in the form of a strip elongated in the direction Y. The extensions 356 are connected to the main portion. In this embodiment, the common electrode strip portion 351, the straight portion 354, the slant portion 355 and the extension 356 have a width of e.g. about 47.5 μm. Each of the relay electrodes 37 is electrically positioned between the common electrode 35 and one of the individual electrodes 33. Each relay electrode 37 includes two relay electrode strip portions 371 and a connecting portion 373. As shown in FIGS. 4 and 6, each relay electrode strip portion 371 provides the second electrically conductive portion 32 of the electrode layer 3 and is in the form of a strip extending in the direction X. That is, the second electrically conductive portion 32 and the first electrically conductive portion 31 of the electrode layer 3 are spaced apart from each other, and in this embodiment, spaced apart from each other in the direction X. The relay electrode strip portions 371 are spaced apart from each other in the direction Y. The relay electrode strip portions 371 are on the resistor layer 4. On the resistor layer 4, the relay electrode strip portions 371 face the strip portions 331, 351 in the direction X. One of two relay electrode strip portions 371 of each relay electrode 37 is spaced apart from one of the common electrode strip portions 351 in the direction X. The other one of the two relay electrode strip portions 371 of the relay electrode 37 is spaced apart from one of the individual electrode strip portions 331 in the direction X. The connecting portions 373 are elongated in the direction Y. Each of the connecting portions 373 is connected to two relay electrode strip portions 371 of a relay electrode 37. Thus, the two relay electrode strip portions 371 of each relay electrode 37 are electrically connected to each other.

The electrode layer 3 does not necessarily need to include the relay electrodes 37. For instance, the electrode layer may comprise a plurality of individual electrodes and a common electrode adjacent to the individual electrodes.

The resistor layer 4, which is shown in FIGS. 2-6, is on the substrate 11. In this embodiment, the resistor layer 4 is formed directly on the heat storage layer 2. In this embodiment, the resistor layer 4 has a plurality of rectangular portions. In the resistor layer 4, the portions to which electric current from the electrode layer 3 is applied heat up, whereby print dots are formed. The resistor layer 4 is made of a material that has a higher resistivity than that of the material forming the electrode layer 3. Examples of the material for the resistor layer 4 include polysilicon, $TaSiO_2$ and TiON. In this embodiment, the resistor layer 4 is doped with ions (e.g. boron) for the adjustment of the resistance. For instance, the thickness of the resistor layer 4 is 0.2 μm to 1 μm.

As shown in FIGS. 4-6, the resistor layer 4 has a first end surface 416 and a second end surface 417.

As shown in FIGS. 4-6, the first end surface 416 faces the opposite side from the second electrically conductive portion 32 (relay electrode strip portion 371) (i.e., the right side in FIG. 6). The second end surface 417 faces the opposite side from the first electrically conductive portion 31 (individual electrode strip portion 331 or the common electrode strip portion 351) (i.e., the left side in FIG. 6).

As shown in FIG. 6, the resistor layer 4 includes heater portions 41 that heat up during the use of the thermal printhead 101. As shown in FIGS. 4 and 5, the heater portions 41 bridge the first electrically conductive portion 31 and the second electrically conductive portion 32. The heater portions 41 are on the heat storage layer 2.

As shown in FIG. 6, the heater portion 41 has a first contact portion 411 and a second contact portion 412. The first contact portion 411 is in contact with the first electrically conductive portion 31 of the electrode layer 3. The second contact portion 412 is in contact with the second electrically conductive portion 32 of the electrode layer 3.

As shown in FIG. 6, the insulating layer 5 has a portion positioned between the heater portion 41 and the electrode layer 3. Examples of the material for the insulating layer 5 include $SiO_2$ and $SiAlO_2$. The insulating layer 5 includes a first interposing portion 51, a second interposing portion 52 and an intermediate portion 53. As shown in FIGS. 4-6, the first interposing portion 51 is positioned between the first electrically conductive portion 31 and the heater portion 41. The second interposing portion 52 is positioned between the second electrically conductive portion 32 and the heater portion 41. As viewed in the thickness direction Z of the substrate 11, the intermediate portion 53 is sandwiched between the first interposing portion 51 and the second interposing portion 52. The intermediate portion 53 is connected to the first interposing portion 51 and the second interposing portion 52.

As shown in FIGS. 4-6, in this embodiment, the first interposing portion 51 has at least one first opening 511. Though FIGS. 4 and 5 show an example in which the first openings 511 are circular, the shape of each first opening 511 is not limited to this. For instance, the first openings 511 may be rectangular. Although FIGS. 4 and 5 show an example in which the first interposing portion 51 has a plurality of first openings 511, the first interposing portion 51 may have only one first opening 511. The first contact portion 411 of the heater portion 41 is at a position overlapping the first opening 511. As shown in FIG. 6, in this embodiment, a part of the first electrically conductive portion 31 is in the first opening 511.

In this embodiment, the second interposing portion 52 has at least one second opening 521. Though FIGS. 4 and 5 show an example in which the second openings 521 are circular, the shape of each second opening 521 is not limited to this. For instance, the second openings 521 may be rectangular. Although FIGS. 4 and 5 show an example in which the second interposing portion 52 has a plurality of second openings 521, the second interposing portion 52 may have only one second opening 521. The second contact portion 412 of the heater portion 41 is at a position overlapping the second opening 521. As shown in FIG. 6, in this embodiment, a part of the second electrically conductive portion 32 is in the second opening 521.

As shown in FIGS. 4-6, in this embodiment, the insulating layer 5 has portions 581 and 582. The portion 581 is connected to the first interposing portion 51 and covers the first end surface 416. The portion 582 is connected to the second interposing portion 52 and covers the second end surface 417. The portions 581 and 582 are in direct contact with the heat storage layer 2. That is, the heat storage layer 2 has portions that are in direct contact with the insulating layer 5. Unlike this embodiment, however, the insulating layer 5 may not have the portions 581 and 582.

The protective layer 6, which is shown in FIGS. 2 and 6, covers the electrode layer 3, the resistor layer 4 and the insulating layer 5 to protect the electrode layer 3, the resistor layer 4 and the insulating layer 5. The protective layer 6 is made of an insulating material. Examples of the insulating material forming the protective layer 6 include SiN and $SiO_2$. In this embodiment, the protective layer 6 is in direct contact with the electrode layer 3 and the insulating layer 5.

The protective layer 6 has a plurality of through-holes 61 (only one is shown in FIG. 2). The through-holes 61 expose the bonding portions 336.

The wiring board 12, which is shown in FIG. 2, is e.g. a printed circuit board. The wiring board 12 comprises a substrate layer and a non-illustrated wiring layer provided on the substrate layer. For instance, the substrate layer is made of glass epoxy resin. For instance, the wiring layer is made of Cu.

The driver IC 7, which is shown in FIGS. 2 and 3, is provided for applying a potential to each individual electrode 33 and controlling a current to be applied to each heater portion 41. When a potential is applied to each individual electrode 33, a voltage is applied between the common electrode 35 and the individual electrode 33, so that current flows selectively through a heater portion 41. The driver IC 7 is mounted on the wiring board 12. As shown in FIG. 3, the driver IC 7 has a plurality of pads 71. For instance, the pads 71 are arranged in two rows.

The wires 81, which are shown in FIGS. 2 and 3, are made of a conductor such as Au. The wires 81 include wires 811 that are bonded to the driver IC 7 and the electrode layer 3.

Specifically, each of the wires 811 is bonded to a pad 71 of the driver IC 7 and a bonding portion 336, whereby the driver IC 7 is electrically connected to each of the individual electrodes 33. As shown in FIG. 3, the wires 81 further include wires 812 each of which is bonded to a pad 71 of the driver IC 7 and the wiring layer of the wiring board 12. Thus, the driver IC 7 is electrically connected to the connector 83 via the wiring layer. As shown in the figure, the wires 81 include a wire 813 bonded to a main portion 357 of the common electrode 35 and the wiring layer of the wiring board 12. Thus, the common electrode 35 is electrically connected to the wiring layer.

The sealing resin 82, which is shown in FIG. 2, is made of a black resin. The sealing resin 82 covers the driver IC 7, the wires 81 and the protective layer 6 to protect the driver IC 7 and the wires 81. The sealing resin 82 is in direct contact with the protective layer 6. The connector 83 is fixed to the wiring board 12. The connector 83 is used for supplying electric power from outside to the thermal printhead 101 and controlling the driver IC 7.

An example of use of the thermal printhead 101 is briefly explained below.

The thermal printhead 101 is used as incorporated in a printer. As shown in FIG. 2, in the printer, each heater portion 41 of the thermal printhead 101 faces the platen roller 802. In use of the printer, the platen roller 802 rotates to transfer the printing medium 801 in the direction X between the platen roller 802 and the heater portions 41 at a constant speed. The platen roller 802 presses the printing medium 801 against a portion of the protective layer 6 that covers the heater portions 41. Meanwhile, the driver IC applies a potential to selected ones of the individual electrodes 33 shown in FIG. 3. Thus, a voltage is applied between the common electrode 35 and the individual electrodes 33. Thus, current flows selectively through the heater portions 41 to generate heat. The heat generated at the heater portions 41 is conducted to the printing medium 801 via the protective layer 6. As a result, a plurality of dots are printed in a first line region extending linearly in the direction Y on the printing medium 801. The heat generated at the heater portions 41 is also conducted to the heat storage layer 2 and stored in the heat storage layer 2.

As the platen roller 802 further rotates, the printing medium 801 is further transferred in the direction X at a constant speed. Thus, similarly to the printing in the first line region described above, printing is performed in a second line region adjacent to the first line region which extends linearly in the direction Y on the printing medium 801. During the printing in the second line region, in addition to the heat generated at the heater portions 41, the heat stored in the heat storage layer 2 during the printing in the first line region is also conducted to the printing medium 801. Printing in the second line region is performed in this way. Printing on the printing medium 801 is performed in this way by printing a plurality of dots in each line region extending linearly in the direction Y on the printing medium 801.

An example of a method of making the thermal printhead 101 is briefly explained below. In this embodiment, the thermal printhead 101 is made by a semiconductor process.

Figure 7:
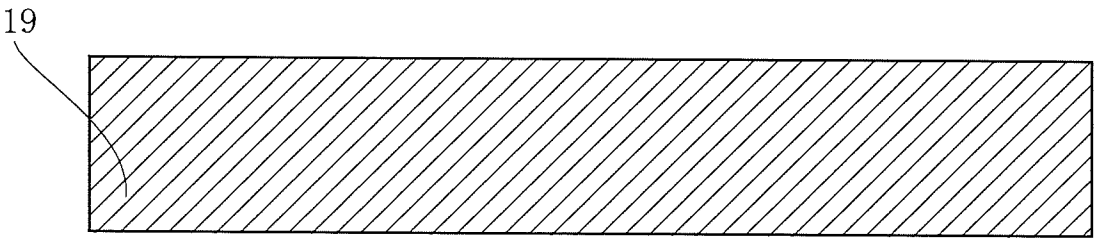
FIG. 7 is a sectional view showing a step of a process of manufacturing a thermal printhead according to a first embodiment of the present invention.
Figure 8:
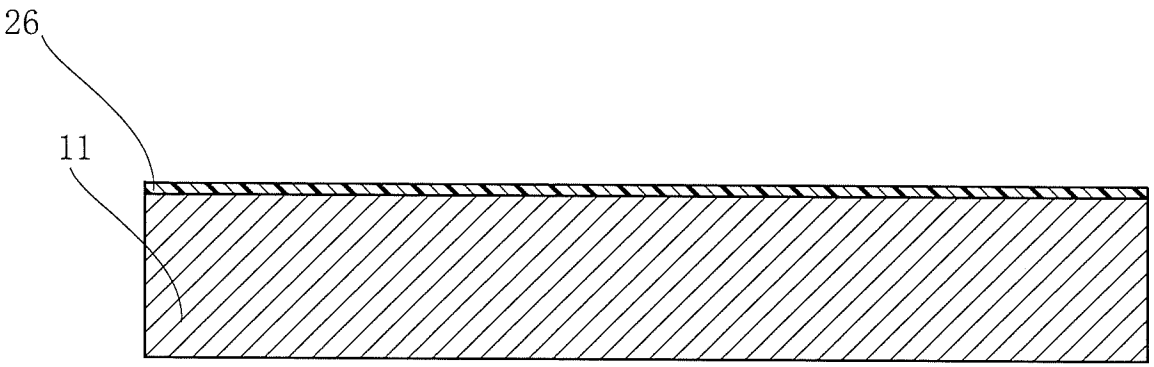
FIG. 8 is a sectional view showing the step subsequent to the step of FIG. 7.
Figure 9:
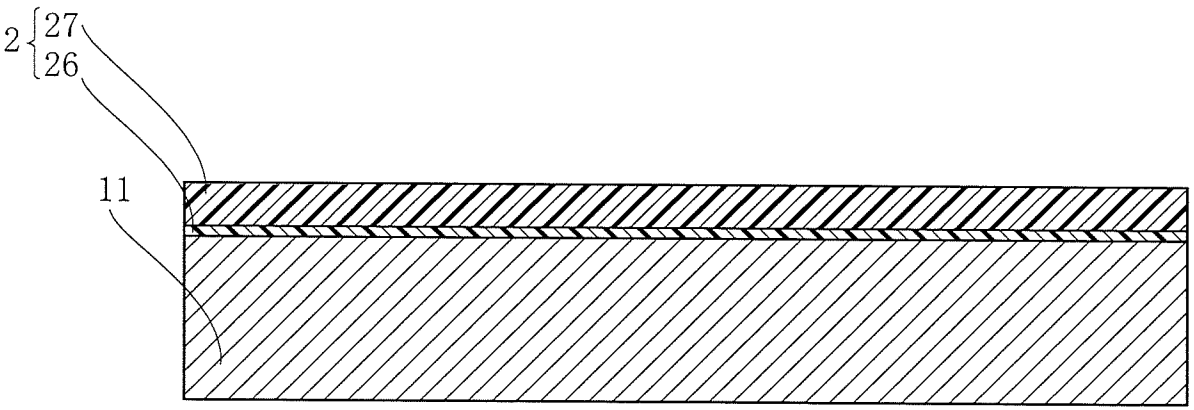
FIG. 9 is a sectional view showing the step subsequent to the step of FIG. 8.

First, as shown in FIG. 7, a semiconductor substrate is prepared. In this embodiment, the semiconductor substrate 19 is made of Si. Then, as shown in FIG. 8, the surface of the semiconductor substrate 19 is thermally oxidized. Thus, the substrate 11, and the first layer 26 on the substrate 11 are obtained. In this embodiment, the first layer 26 is made of $SiO_2$. Then, as shown in FIG. 9, a second layer 27 is formed on the first layer 26 by CVD or sputtering. Thus, the heat storage layer 2 is formed on the substrate 11. Though not illustrated in the figure, an $SiO_2$ layer is formed also on the reverse surface of the substrate 11. Unlike this embodiment, the surface of the semiconductor substrate 19 may not necessarily be oxidized, and the heat storage layer 2 may be directly formed by CVD or sputtering.

Figure 10:
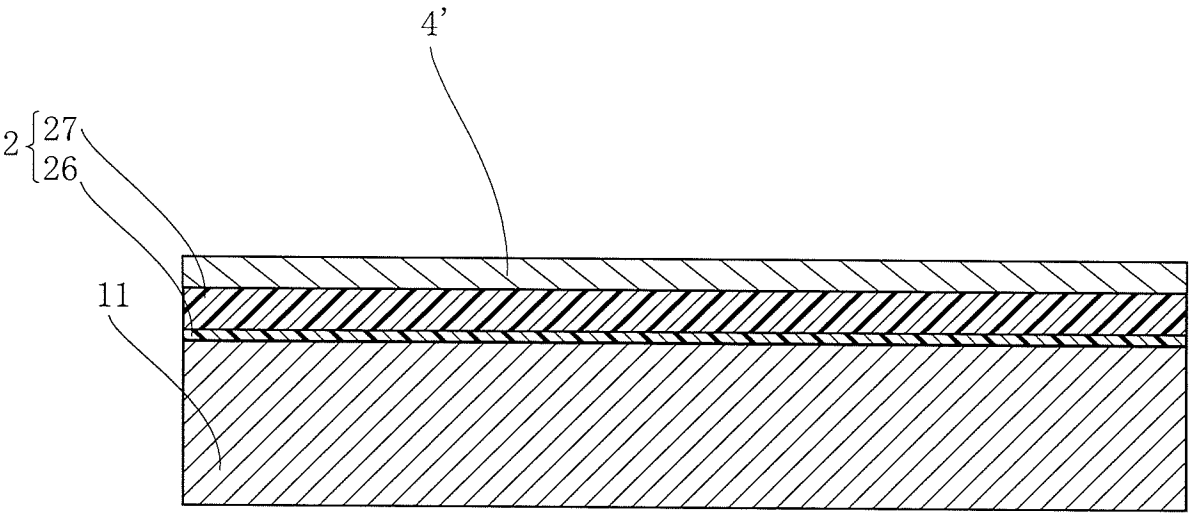
FIG. 10 is a sectional view showing the step subsequent to the step of FIG. 9.
Figure 11:
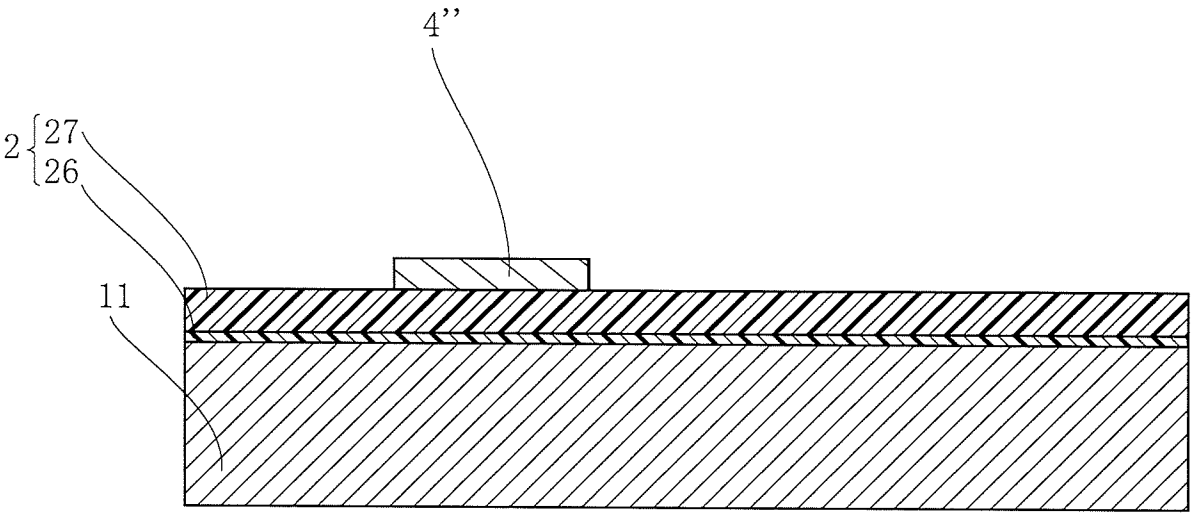
FIG. 11 is a sectional view showing the step subsequent to the step of FIG. 10.
Figure 12:
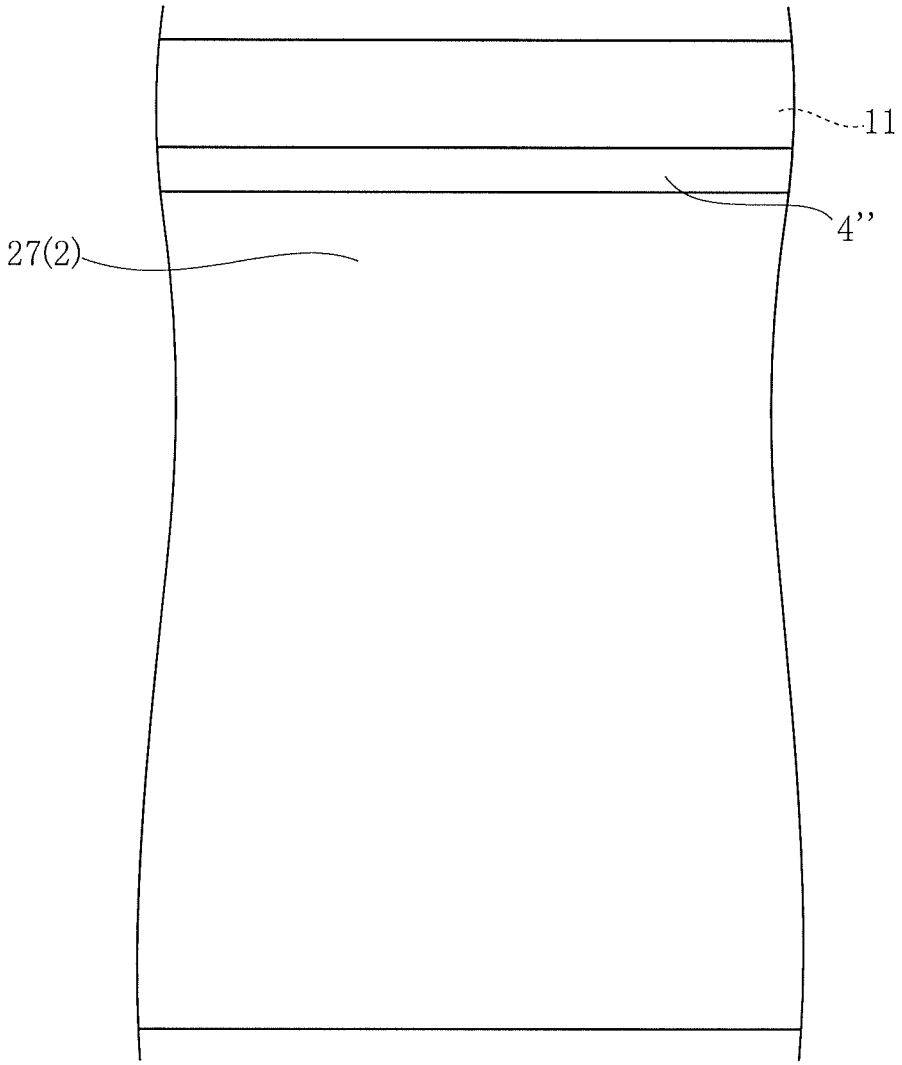
FIG. 12 is a schematic enlarged plan view when the step shown in FIG. 11 is performed.

Then, as shown in FIG. 10, a resistor layer 4' is formed. The resistor layer 4' may be formed by CVD or sputtering. The resistor layer 4' is formed on the entire surface of the substrate 11. Then, as shown in FIGS. 11 and 12, a resistor layer 4" is formed by etching the resistor layer 4'. Etching of the resistor layer 4' is performed by photolithography. As shown in FIG. 12, in this embodiment, the resistor layer 4" is in the form of a strip elongated in one direction. Then, ions (not shown) are implanted into the resistor layer 4" so that the resistor layer 4 has a desired resistance.

Figure 13:
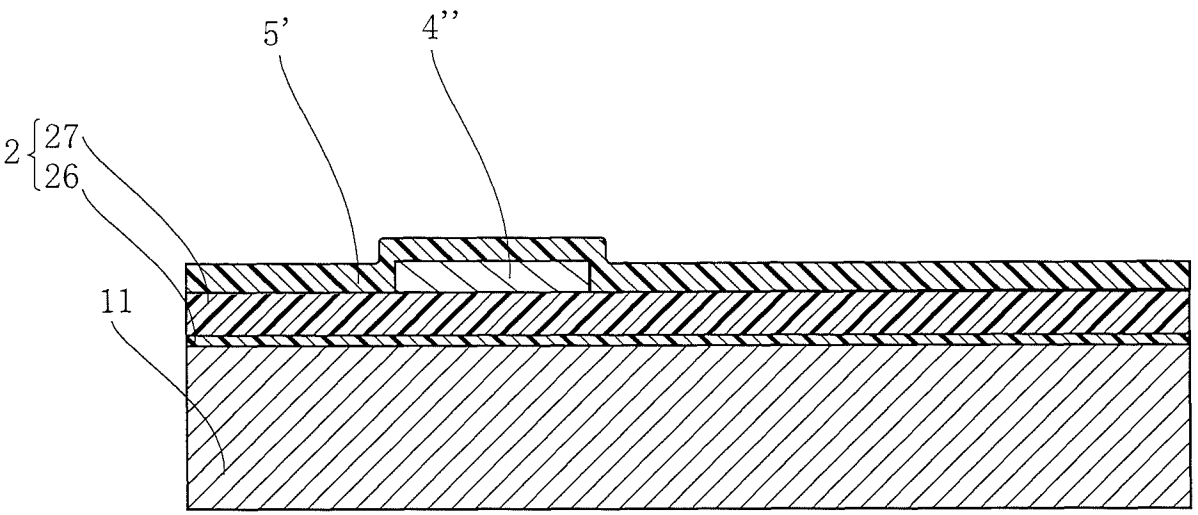
FIG. 13 is a sectional view showing the step subsequent to the step of FIG. 11.
Figure 14:
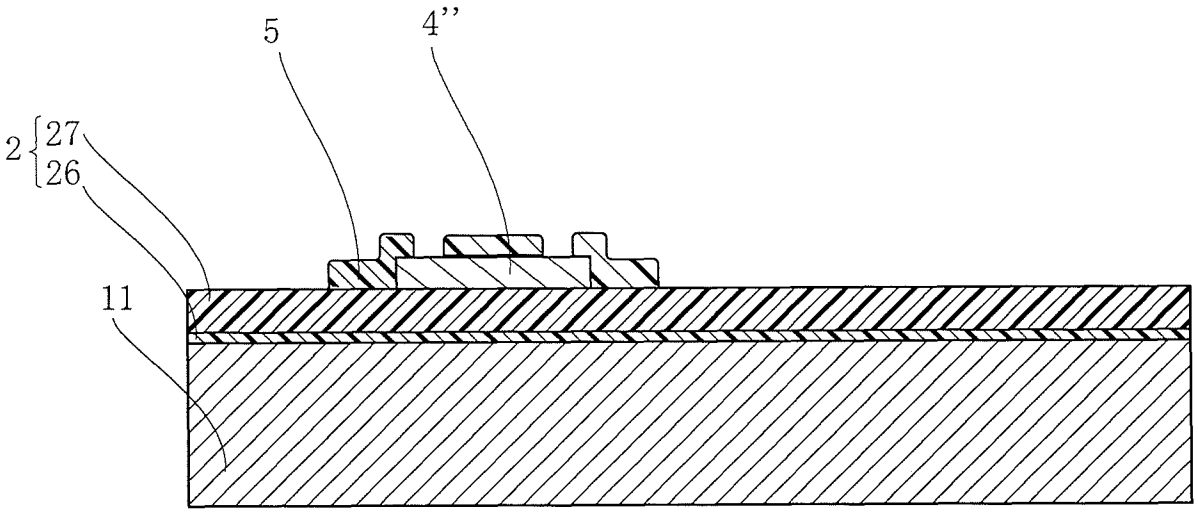
FIG. 14 is a sectional view showing the step subsequent to the step of FIG. 13.
Figure 15:
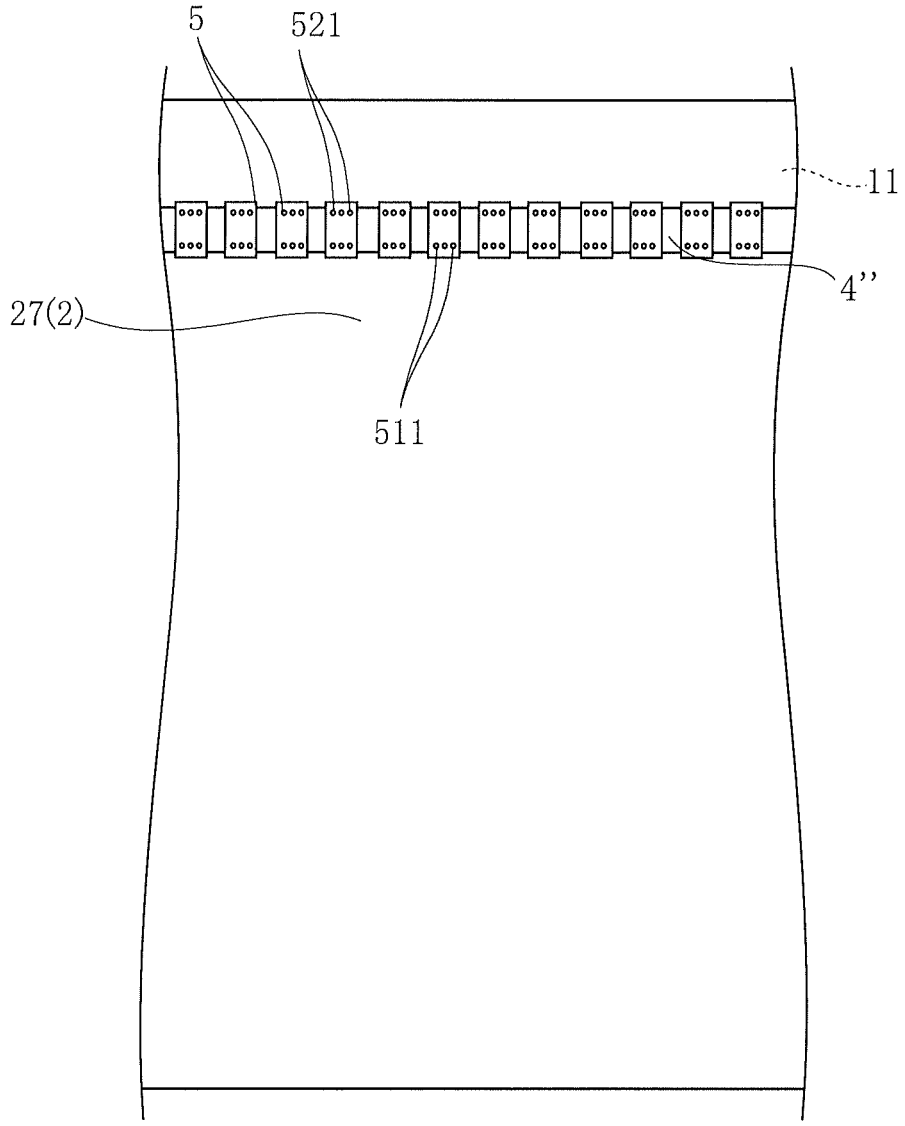
FIG. 15 is a schematic enlarged plan view when the step shown in FIG. 14 is performed.

Then, as shown in FIG. 13, an insulating layer 5' is formed. The insulating layer 5' is formed by CVD or sputtering. Then, as shown in FIGS. 14 and 15, by etching the insulating layer 5', the above-described insulating layer 5 is obtained. The above-described first openings 511 and the second openings 521 are formed in the process of etching the insulating layer 5'.

Figure 16:
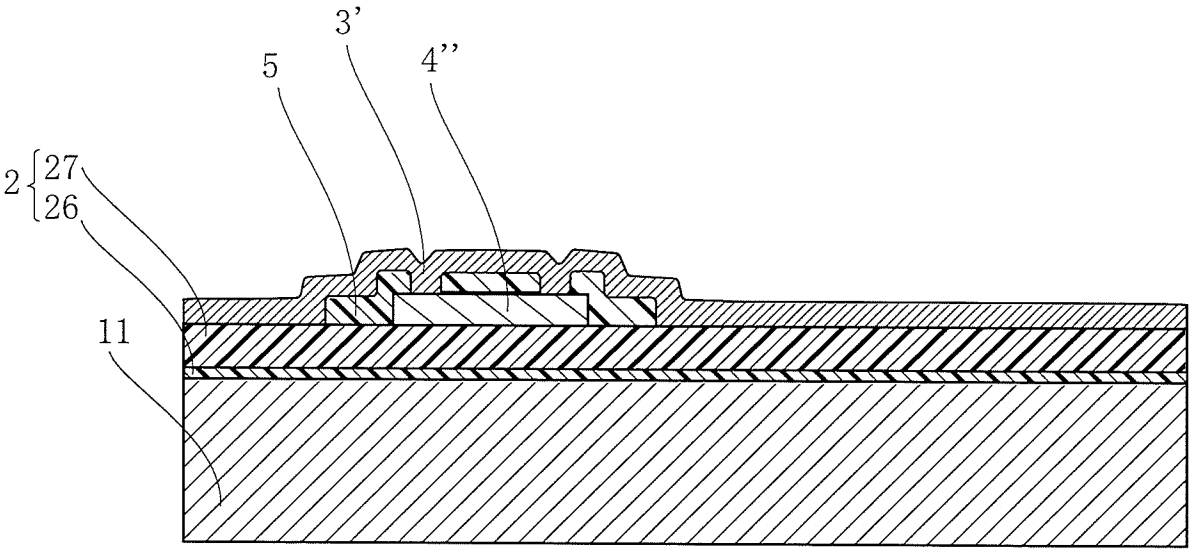
FIG. 16 is a sectional view showing the step subsequent to the step of FIG. 14.
Figure 17:
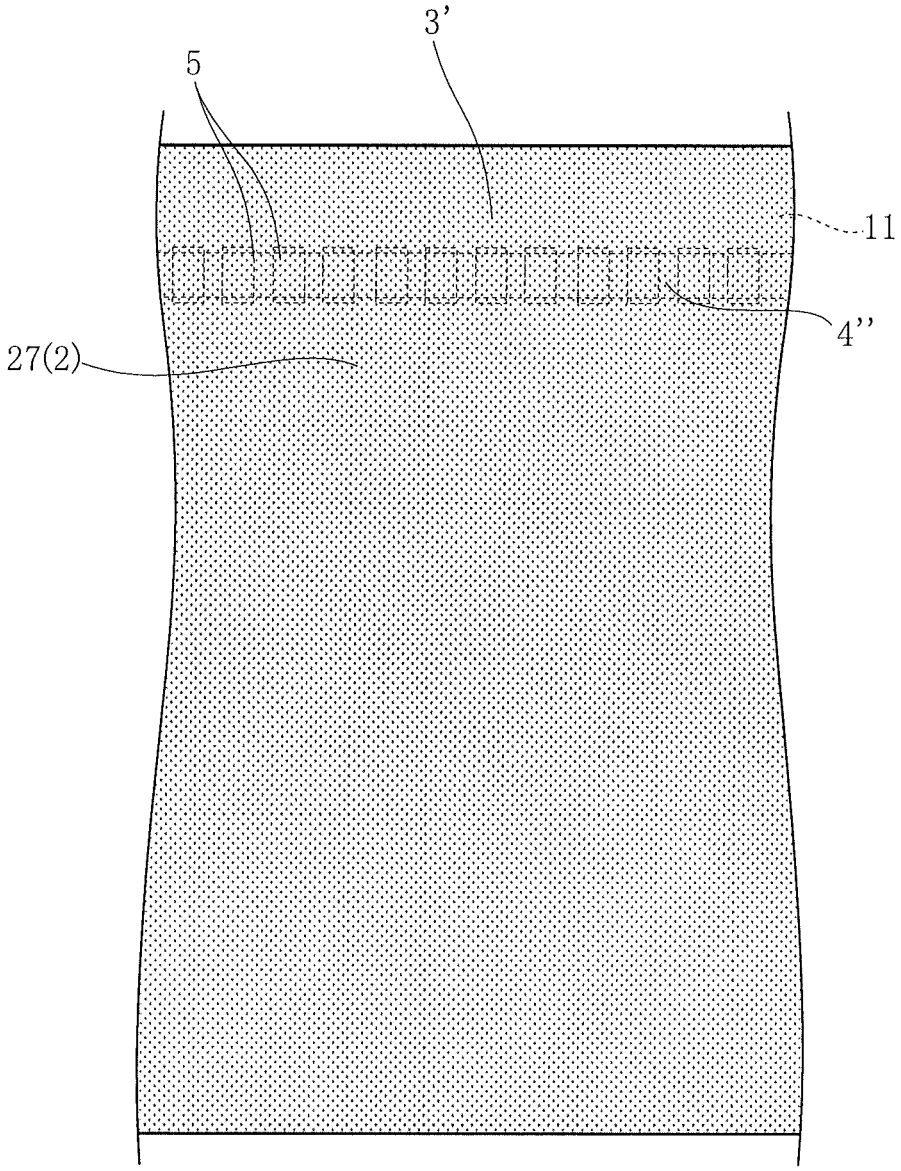
FIG. 17 is a schematic enlarged plan view when the step shown in FIG. 16 is performed.
Figure 18:
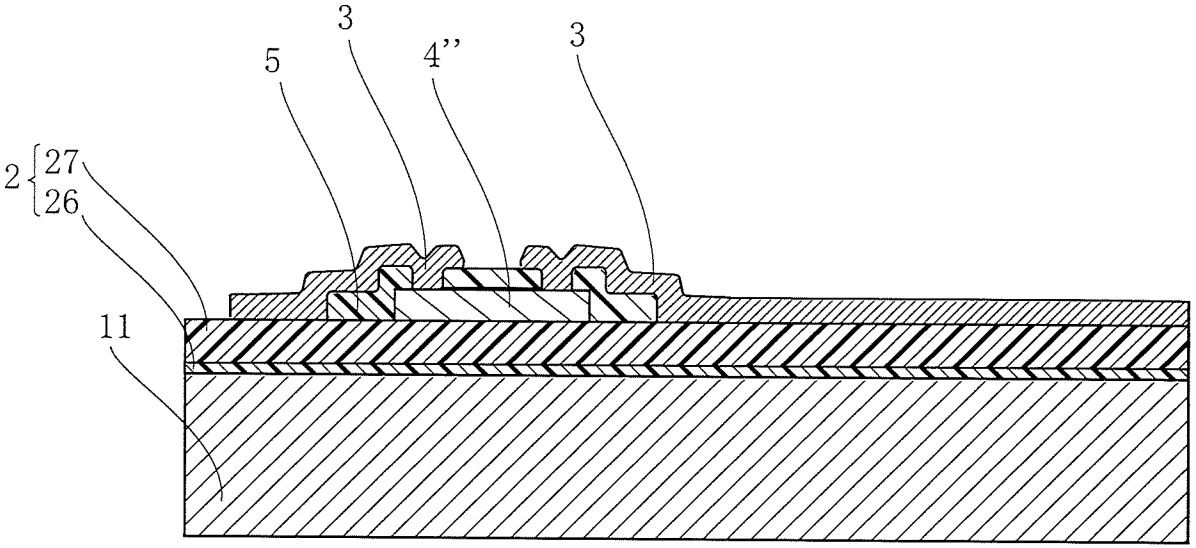
FIG. 18 is a sectional view showing the step subsequent to the step of FIG. 16.
Figure 19:
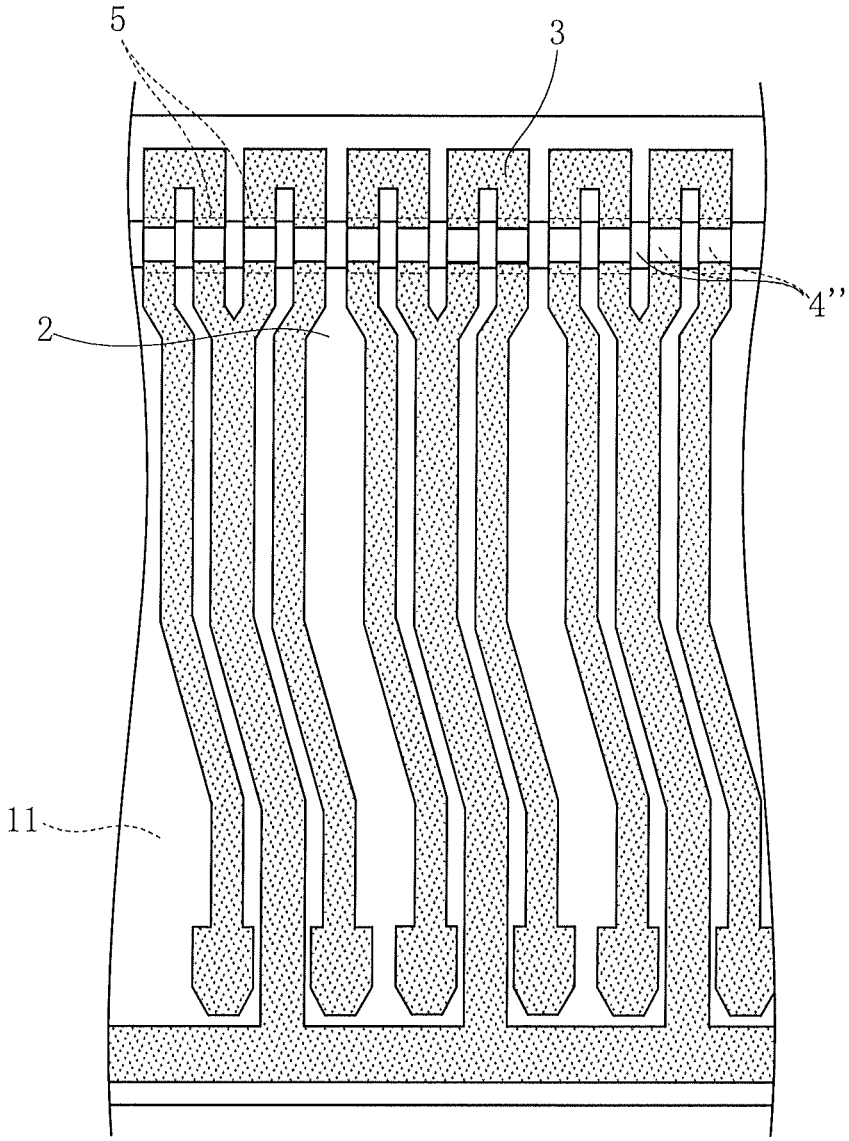
FIG. 19 is a schematic enlarged plan view when the step shown in FIG. 18 is performed.

Then, as shown in FIGS. 16 and 17, an electrode layer 3' is formed. Specifically, the electrode layer 3' is formed by e.g. sputtering or CVD. Then, as shown in FIGS. 18 and 19, the above-described electrode layer 3 is formed by etching the electrode layer 3'. Etching of the electrode layer 3' is performed by photolithography.

Figure 20:
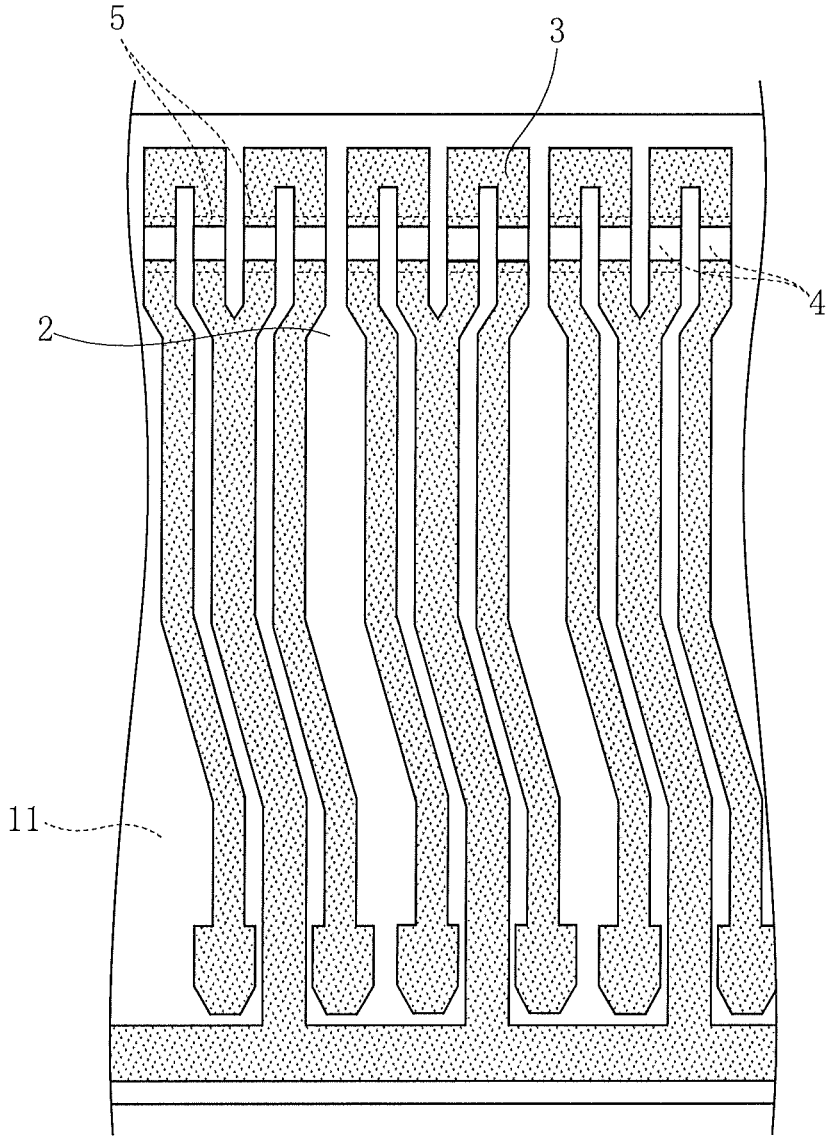
FIG. 20 is a schematic enlarged plan view showing the step subsequent to the step of FIG. 19.

Then, as shown in FIG. 20, the above-described resistor layer 4 having a plurality of rectangular portions is formed by etching the resistor layer 4". This is performed to prevent a current from flowing through the resistor layer 4 in the horizontal direction in FIG. 20 during the use of the thermal printhead 101. Unlike this embodiment, the resistor layer 4" in the form of a strip may not be formed, and the resistor layer 4 having a plurality of rectangular portions may be formed by etching the resistor layer 4' just once.

Figure 21:
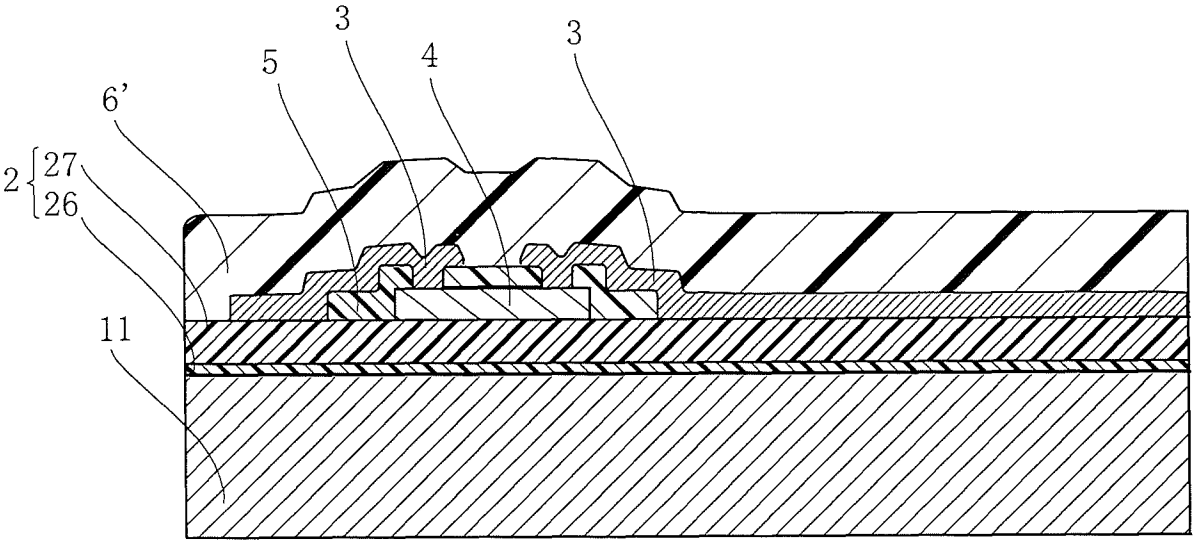
FIG. 21 is a sectional view showing the step subsequent to the step of FIG. 20.
Figure 22:
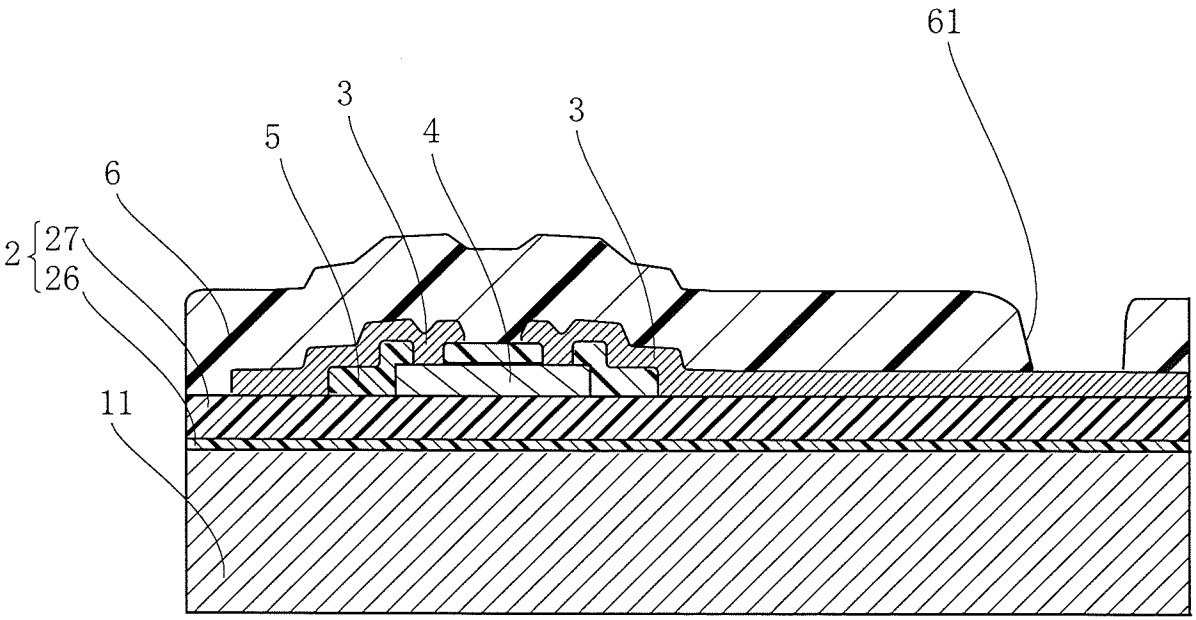
FIG. 22 is a sectional view showing the step subsequent to the step of FIG. 21.

Then, as shown in FIG. 21, a protective layer 6' is formed. For instance, the protective layer 6' is formed by CVD. Then, as shown in FIG. 22, a plurality of through-holes 61 is formed by etching the protective layer 6'. The etching of the protective layer 6' is performed by photolithography.

Then, though not shown in the figure, the thickness of the substrate 11 is reduced by grinding the reverse surface of the substrate 11. Then, after the resistance of the resistor layer 4 is measured and the substrate 11 is diced, the diced product and the wiring board 12 are placed on a heat sink plate 13. Then, the driver IC 7 shown in FIG. 2 is mounted on the wiring board 12, the wires 81 are bonded to appropriate portions, and the sealing resin 82 is formed. The thermal printhead 101 shown in FIG. 2 is manufactured by these process steps.

The advantages of the above embodiment are described below.

The thermal printhead 101 of this embodiment has an insulating layer 5. A part of the insulating layer 5 is positioned between the electrode layer 3 and the heater portion 41. This arrangement reduces the area where the electrode layer 3 and the heater portion 41 come into contact with each other. With this arrangement, it is possible to reduce the formation of the eutectic region between the electrode layer 3 and the heater portion 41 when the heater portion 41 heats up due to the flow of a current. Reducing the eutectic region of the electrode layer 3 and the heater portion 41 reduces variation of the resistance during the use of the thermal printhead 101.

In this embodiment, the insulating layer 5 has a first interposing portion 51 and a second interposing portion 52. The first interposing portion 51 is positioned between the first electrically conductive portion 31 and the heater portion 41. This arrangement reduces the formation of the eutectic region between the first electrically conductive portion 31 and the heater portion 41. In this embodiment, the second interposing portion 52 is positioned between the second electrically conductive portion 32 and the heater portion 41. This arrangement reduces the formation of the eutectic region between the second electrically conductive portion 32 and the heater portion 41. Reducing the eutectic region of the first electrically conductive portion 31 and the heater portion 41 or the eutectic region of the second electrically conductive portion 32 and the heater portion 41 reduces the eutectic region between the electrode layer and the heater portion 41. Thus, variation of the resistance of the thermal printhead 101 during the use of the thermal printhead 101 reduces.

If the electrode layer 3 is positioned between the resistor layer 4 and the heat storage layer 2, the heat generated at the heater portion 41 of the resistor layer 4 may be released to the electrode layer 3, and the heat released to the electrode layer 3 does not contribute to the heat conduction to the printing medium 801. In this embodiment, however, the resistor layer 4 is positioned between the electrode layer 3 and the heat storage layer 2. With this arrangement, even when the heat generated at the heater portion 41 of the resistor layer 4 is conducted to the electrode layer 3, the heat conducted to the electrode layer 3 can contribute to the heat conduction to the printing medium 801. Thus, the heat generated at the heater portion 41 is efficiently conducted to the printing medium 801. In other words, this arrangement assures that the portion (protective layer 6) of the thermal printhead 101 which comes into contact with the printing medium 801 is quickly raised to a high temperature, which realizes high speed printing on the printing medium 801.

In this embodiment, the substrate 11 is made of Si. Since Si has high heat conductivity, the heat generated at the heater portion 41 is quickly transferred to the outside of the substrate 11 (to the heat sink plate 13 in this embodiment). Thus, the heater portion 41, which has been heated to a high temperature, is quickly cooled. This is favorable for increasing the printing speed on the printing medium 801.

In this embodiment, the through-holes 61 of the protective layer 6 are formed by etching the protective layer 6'. This assures that the through-holes 61 are formed at desired positions of the protective layer 6. Therefore, it is not necessary to cover a portion of the electrode layer 3 which is not covered by the protective layer 6 by a resin layer (solder resist layer) different from the sealing resin 82. Since forming another resist layer (solder resist layer) is not necessary, the manufacturing efficiency of the thermal printhead 101 is enhanced.

In the description given below, the elements that are identical or similar to those of the foregoing embodiment are designated by the same reference signs as those used for the foregoing embodiment, and the description is omitted appropriately.

Second Embodiment

A second embodiment of the present invention is described with reference to FIG. 23.

Figure 23:
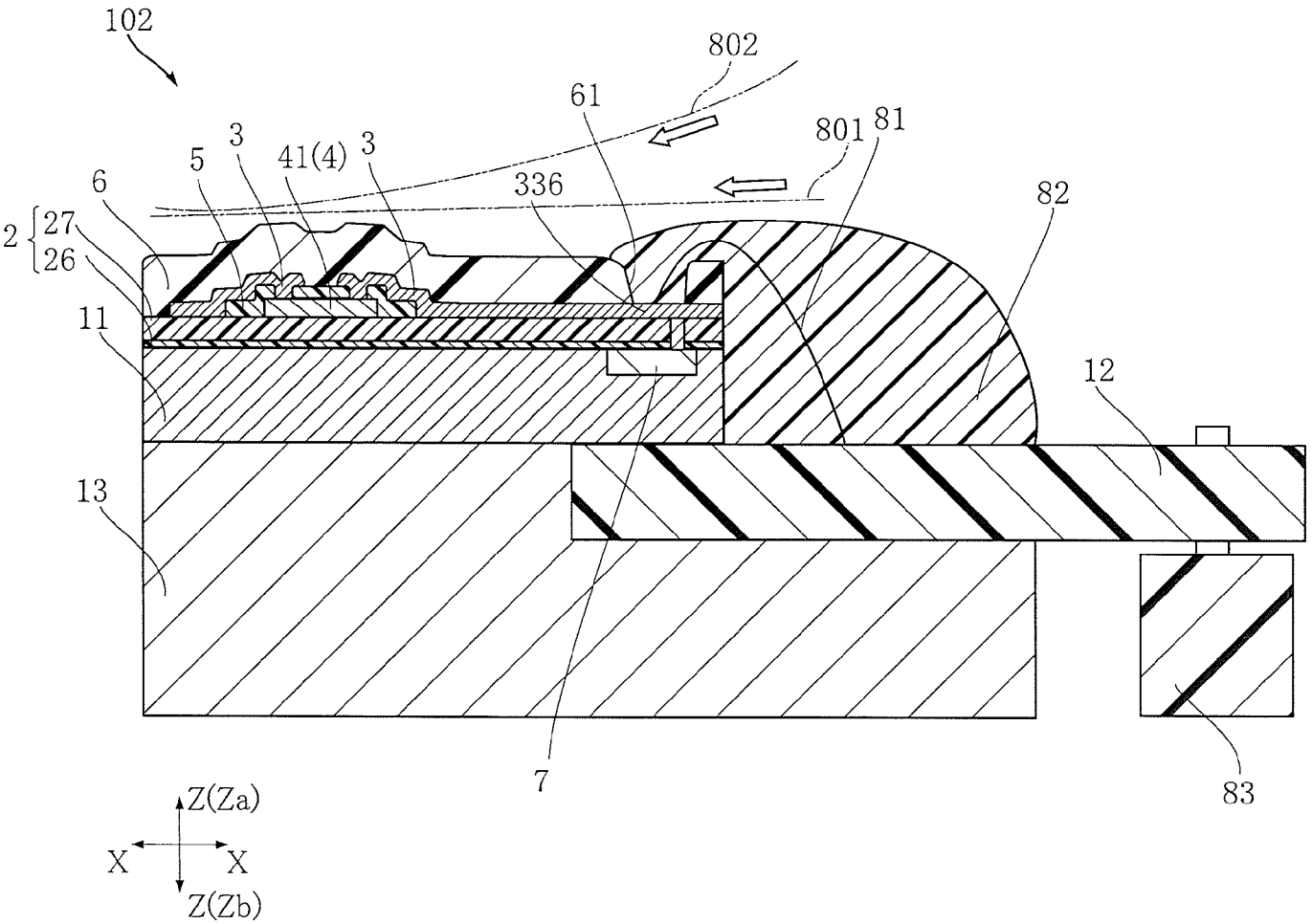
FIG. 23 is a sectional view of a thermal printhead according to a second embodiment of the present invention.

FIG. 23 is a sectional view of a thermal printhead according to a second embodiment of the present invention.

The thermal printhead 102 shown in the figure is different from the above-described thermal printhead 101 in that the driver IC 7 is built in the substrate 11. Since other portions are the same as the foregoing embodiment, the description is omitted. The substrate 11 of the thermal printhead 102 is made of a semiconductor material. The driver IC 7 and the electrode layer 3 are electrically connected to each other through the vias penetrating the heat storage layer 2. This arrangement makes it possible to make the thermal printhead 102 by using a smaller number of parts. Moreover, the thermal printhead 102 has the same advantages as those described with respect to the thermal printhead 101.

Third Embodiment

A third embodiment of the present invention is described with reference to FIG. 24.

Figure 24:
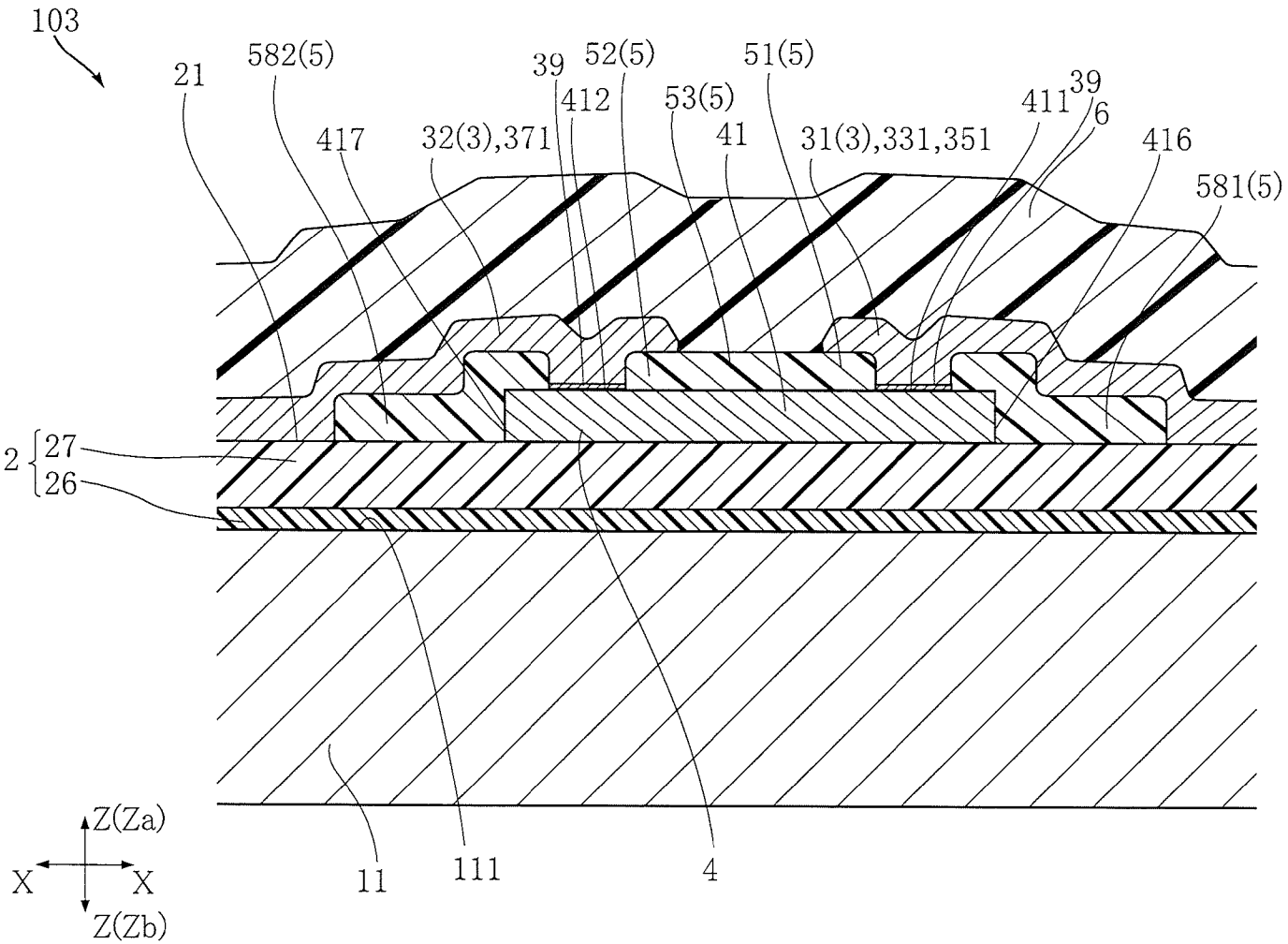
FIG. 24 is a schematic enlarged sectional view of a thermal printhead according to a third embodiment of the present invention.

FIG. 24 is a schematic enlarged sectional view of a thermal printhead according to a third embodiment of the present invention.

The thermal printhead 103 is different from the thermal printhead 101 in that the electrode layer 3 has a barrier metal layer 39. For instance, the barrier metal layer 39 is made of TiN. The barrier metal layer 39 is in direct contact with the resistor layer 4. Between the electrode layer 3 and the resistor layer 4, the barrier metal layer 39 functions to prevent diffusion of the material forming the electrode layer 3 or the resistor layer 4 and reaction of the electrode layer 3 and the resistor layer 4. Moreover, the thermal printhead 103 has the same advantages as those described with respect to the thermal printhead 101.

<First Variation>

A first variation of an embodiment of the present invention is described below with reference to FIG. 25.

Figure 25:
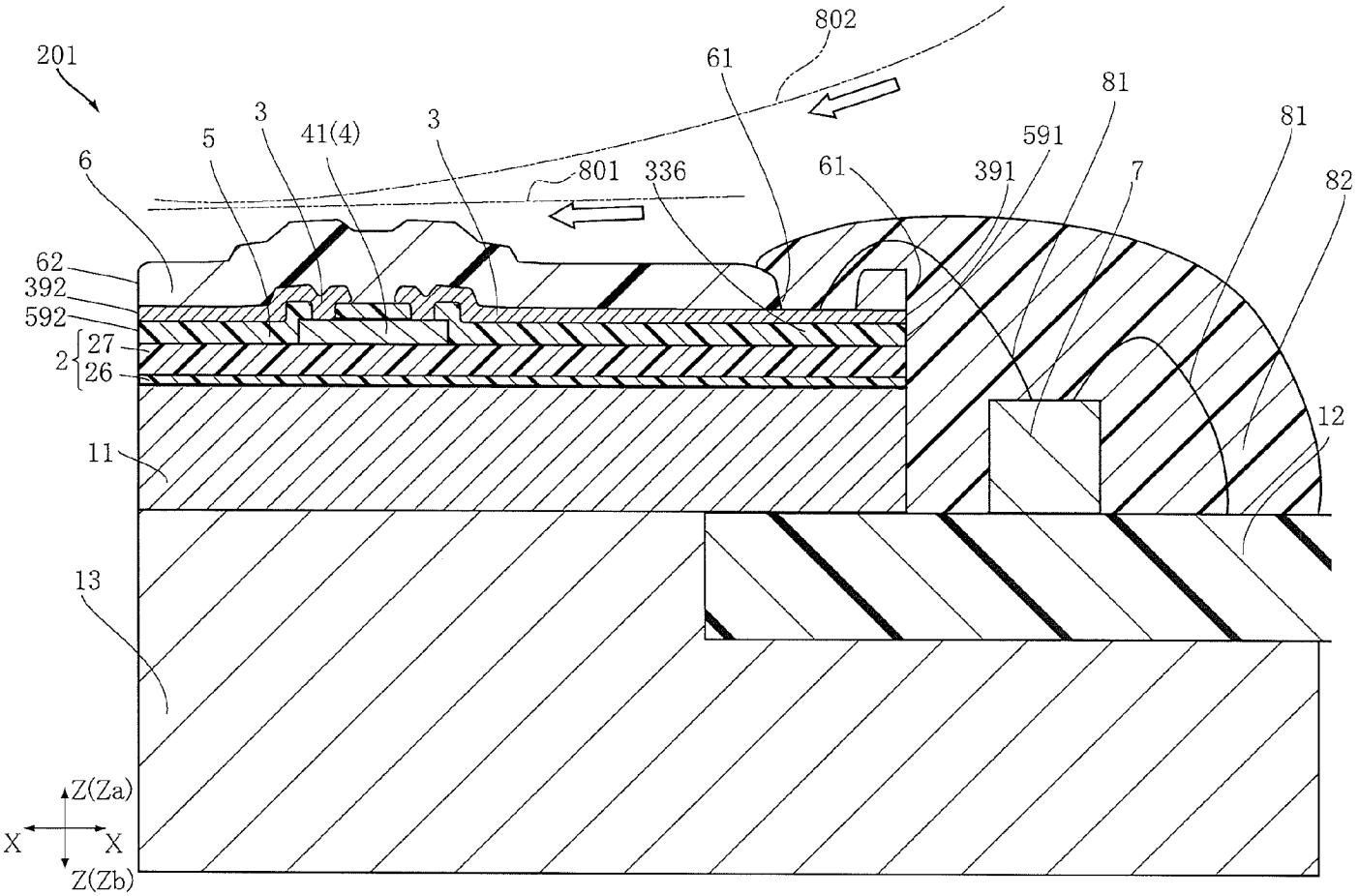
FIG. 25 is a schematic enlarged sectional view of a thermal printhead according to a first variation of an embodiment of the present invention.

FIG. 25 is a schematic enlarged sectional view of a thermal printhead according to a first variation of an embodiment of the present invention.

The thermal printhead 201 shown in the figure is different from the thermal printhead 101 of the first embodiment in structure of the electrode layer 3 and the insulating layer 5. Both of the right end of the electrode layer 3 and the right end of the insulating layer 5 reach the right end of the substrate 11 and are exposed from the protective layer 6. Similarly, both of the left end of the electrode layer 3 and the left end of the insulating layer 5 reach the substrate 11 and are exposed from the protective layer 6. An insulating layer 5 or a resistor layer 4 is provided between the electrode layer 3 and the heat storage layer 2. Thus, the electrode layer 3 is not in contact with the heat storage layer 2.

Specifically, the electrode layer 3 includes a first electrode layer end surface 391 and a second electrode layer end surface 392. The first electrode layer end surface 391 faces a first side (right side in FIG. 25) in the direction X. The second electrode layer end surface 392 faces a second side (left side in FIG. 25) in the direction X. Similarly, the insulating layer 5 includes a first insulating layer end surface 591 and a second insulating layer end surface 592. The first insulating layer end surface 591 faces the first side (right side in FIG. 25) in the direction X. The second insulating layer end surface 592 faces the second side (left side in FIG. 25) in the direction X. Similarly, the protective layer 6 includes a first protective layer end surface 61 and a second protective layer end surface 62. The first protective layer end surface 61 faces the first side (right side in FIG. 25) in the direction X. The second protective layer end surface 62 faces the second side (left side in FIG. 25) in the direction X.

In this variation, the first electrode layer end surface 391 and the first insulating layer end surface 591 are exposed from the protective layer 6. The first electrode layer end surface 391, the first insulating layer end surface 591 and the first protective layer end surface 61 are flush with each other. Similarly, the second electrode layer end surface 392 and the second insulating layer end surface 592 are exposed from the protective layer 6. The second electrode layer end surface 392, the second insulating layer end surface 592 and the second protective layer end surface 62 are flush with each other.

With the above-described arrangement again, the thermal printhead has the same advantages as those described with respect to the thermal printhead 101. The structure of this variation may be employed as a variation of the thermal printhead 102, 103.

<Second Variation>

A second variation of an embodiment of the present invention is described with reference to FIG. 26.

Figure 26:
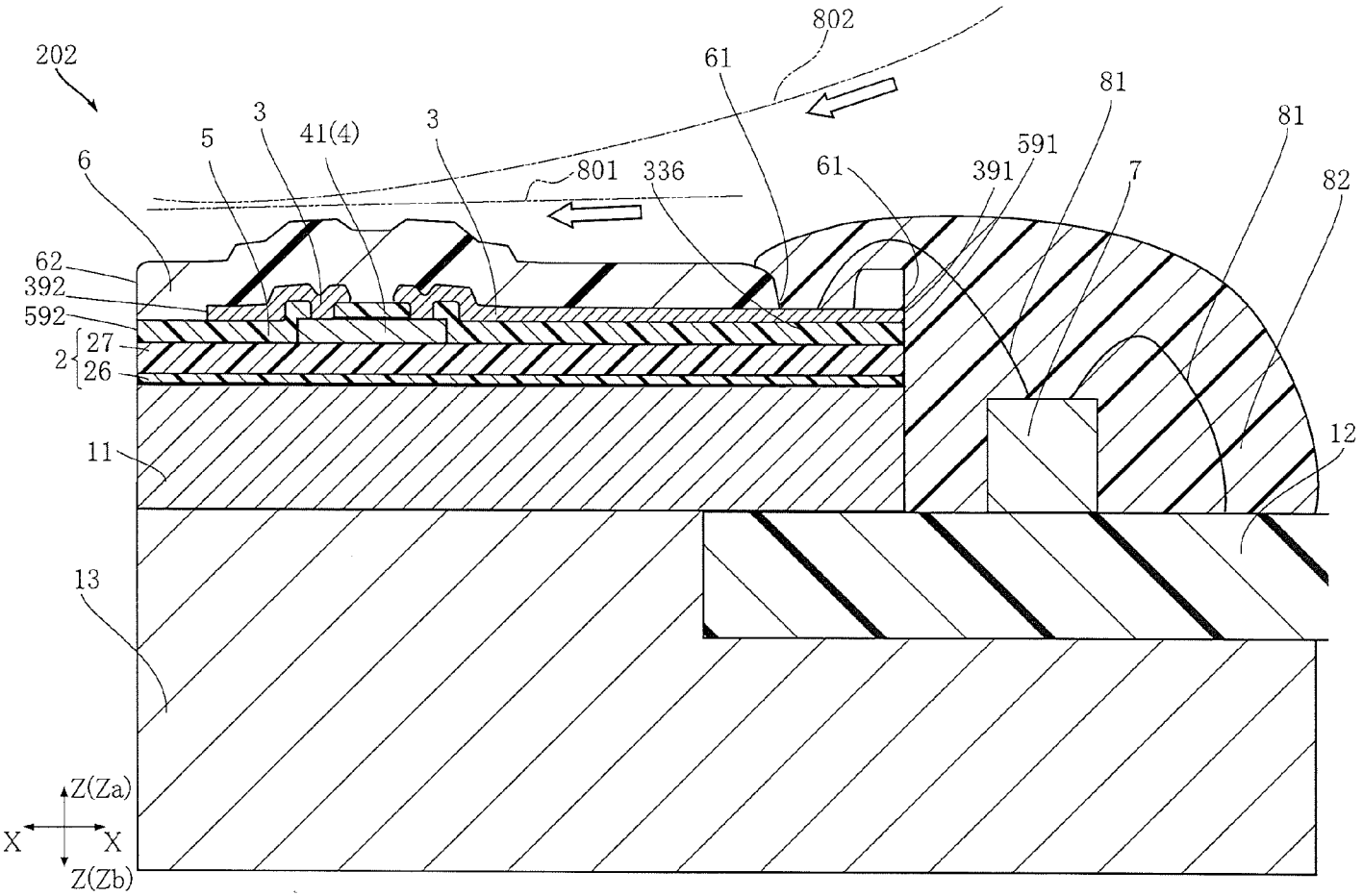
FIG. 26 is a schematic enlarged sectional view of a thermal printhead according to a second variation of an embodiment of the present invention.

FIG. 26 is a schematic enlarged sectional view of a thermal printhead according to a second variation of an embodiment of the present invention.

The thermal printhead 202 shown in the figure is different from the thermal printhead 201 in structure of the left end of the electrode layer 3. In this variation again, both of the right end of the electrode layer 3 and the right end of the insulating layer 5 reach the right end of the substrate 11 and are exposed from the protective layer 6. The left end of the insulating layer 5 reaches the left end of the substrate 11 and is exposed from the protective layer 6. However, the left end of the electrode layer 3 does not reach the left end of the substrate 11 and is not exposed from the protective layer 6. In this variation again, an insulating layer 5 or a resistor layer 4 is provided between the electrode layer 3 and the heat storage layer 2. Thus, the electrode layer 3 is not in contact with the heat storage layer 2.

Specifically, the first electrode layer end surface 391 and the first insulating layer end surface 591 are exposed from the protective layer 6. The first electrode layer end surface 391, the first insulating layer end surface 591 and the first protective layer end surface 61 are flush with each other. The second insulating layer end surface 592 is exposed from the protective layer 6. The second insulating layer end surface 592 and the second protective layer end surface 62 are flush with each other. The second electrode layer end surface 392 is not exposed from the protective layer 6 but covered by the protective layer 6. The second electrode layer end surface 392 is positioned on the heater portion 41 side (right side in the figure) of the second insulating layer end surface 592. Thus, the insulating layer 5 exists between the left end of the electrode layer 3 and the heat storage layer 2. Thus, the left end of the electrode layer 3 is not in contact with the heat storage layer 2.

With the above-described arrangement again, the thermal printhead has the same advantages as those described with respect to the thermal printhead 101. The structure of this variation may be employed as a variation of the thermal printhead 102, 103.

<Third Variation>

A third variation of an embodiment of the present invention is described with reference to FIG. 27.

Figure 27:
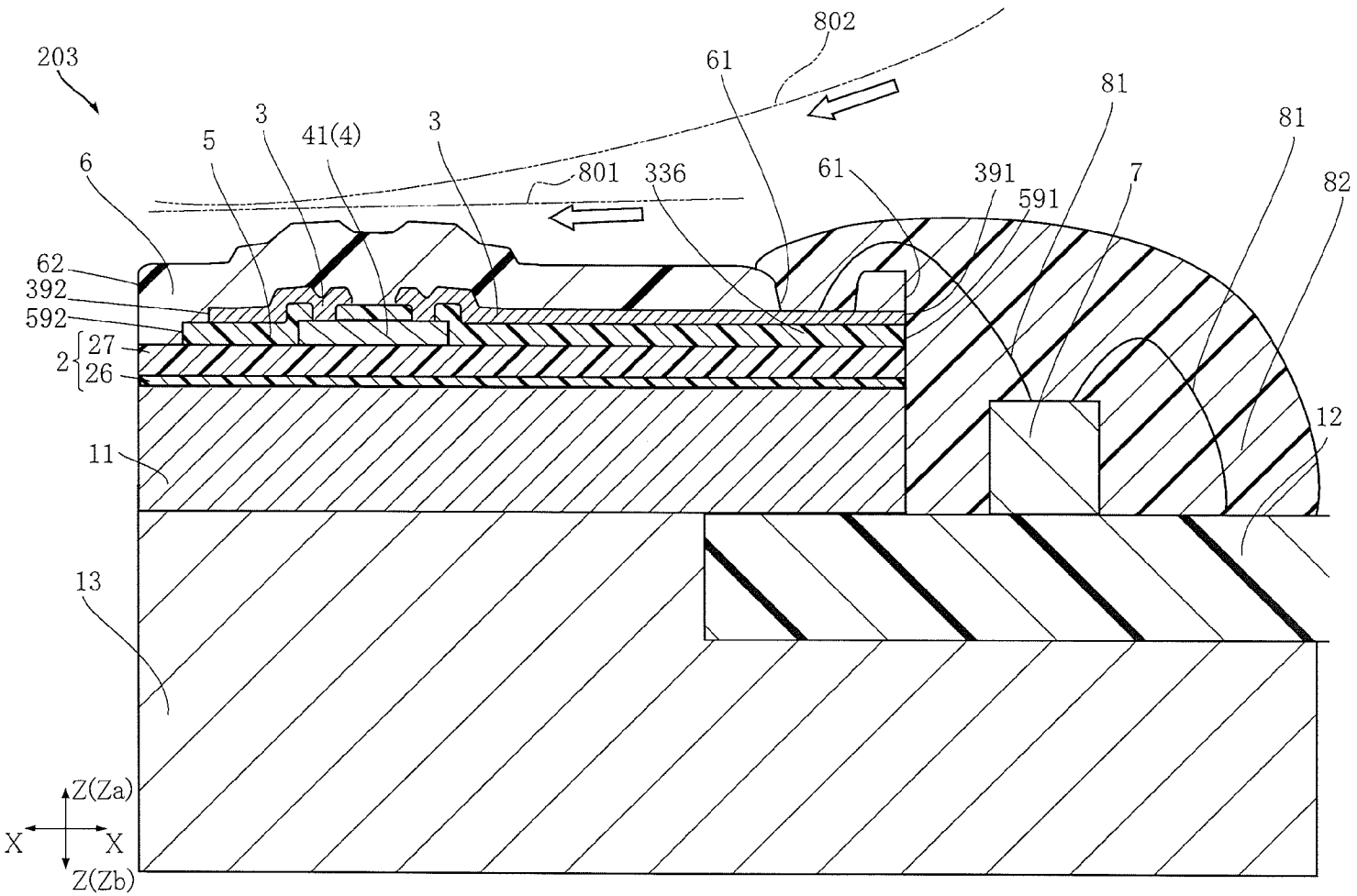
FIG. 27 is a schematic enlarged sectional view of a thermal printhead according to a third variation of an embodiment of the present invention.

FIG. 27 is a schematic sectional view of a thermal printhead according to a third variation of an embodiment of the present invention.

The thermal printhead 203 shown in the figure is different from the thermal printhead 201 in structure of the left end of the electrode layer 3 and the left end of the insulating layer 5. In this variation again, both of the right end of the electrode layer 3 and the right end of the insulating layer 5 reach the right end of the substrate 11 and are exposed from the protective layer 6. The left end of the insulating layer 5 and the left end of the electrode layer 3 are not exposed from the protective layer 6. In this variation again, an insulating layer 5 or a resistor layer 4 is provided between the electrode layer 3 and the heat storage layer 2. Thus, the electrode layer 3 is not in contact with the heat storage layer 2.

Specifically, the first electrode layer end surface 391 and the first insulating layer end surface 591 are exposed from the protective layer 6. The first electrode layer end surface 391, the first insulating layer end surface 591 and the first protective layer end surface 61 are flush with each other. The second electrode layer end surface 392 and the second insulating layer end surface 592 are not exposed from the protective layer 6 and covered by the protective layer 6. The second electrode layer end surface 392 is positioned on the heater portion side (right side in the figure) of the second insulating layer end surface 592. Thus, the insulating layer 5 exists between the left end of the electrode layer 3 and the heat storage layer 2. Thus, the left end of the electrode layer 3 is not in contact with the heat storage layer 2.

With the above-described arrangement again, the thermal printhead has the same advantages as those described with respect to the thermal printhead 101. The structure of this variation may be employed as a variation of the thermal printhead 102, 103.

The present invention is not limited to the foregoing embodiments. The specific structure of each part of the present invention can be varied in design in many ways.

The invention claimed is:

1. A thermal printhead comprising:

a substrate;

a resistor layer formed on the substrate;

an electrode layer formed on the substrate and electrically connected to the resistor layer; and an insulating layer;

wherein the electrode layer includes a first electrically conductive portion and a second electrically conductive portion spaced apart from each other, the resistor layer includes a heater portion that bridges the first electrically conductive portion and the second electrically conductive portion as viewed in a thickness direction of the substrate, the insulating layer includes an intervening portion positioned between the electrode layer and the heater portion in the thickness direction of the substrate, and the first electrically conductive portion and the second electrically conductive portion are connected to the resistor layer via a plurality of openings formed in the intervening portion of the insulating layer.

2. The thermal printhead according to claim 1, wherein the intervening portion of the insulating layer includes a first interposing portion and a second interposing portion, the first interposing portion is positioned between the first electrically conductive portion and the heater portion in the thickness direction of the substrate, and the second interposing portion is positioned between the second electrically conductive portion and the heater portion in the thickness direction of the substrate.

3. The thermal printhead according to claim 2, wherein the insulating layer includes an intermediate portion sandwiched between the first interposing portion and the second interposing portion as viewed in the thickness direction of the substrate, and the intermediate portion is connected to the first interposing portion and the second interposing portion.

4. The thermal printhead according to claim 1, wherein the insulating layer is made of $SiO_2$ or $SiAlO_2$.

5. The thermal printhead according to claim 1, wherein the substrate is made of a semiconductor material.

6. The thermal printhead according to claim 1, wherein each of the first electrically conductive portion and the second electrically conductive portion is held in direct contact with the resistor layer only at the heater portion.

* * * * *